US006544109B1

(12) United States Patent
Moore

(10) Patent No.: US 6,544,109 B1
(45) Date of Patent: Apr. 8, 2003

(54) SLURRY DELIVERY AND PLANARIZATION SYSTEMS

(75) Inventor: Scott E. Moore, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 84 days.

(21) Appl. No.: 09/655,003

(22) Filed: Aug. 31, 2000

(51) Int. Cl.[7] ..... B24B 1/00; B24B 7/00

(52) U.S. Cl. ..... 451/60; 451/99; 451/41; 451/285; 451/287

(58) Field of Search ..... 451/60, 99, 41, 451/8, 9, 285–290

(56) References Cited

U.S. PATENT DOCUMENTS

| | | | | |
|---|---|---|---|---|
| 2,733,814 A | * | 2/1956 | Booth | 406/128 |
| 3,865,352 A | | 2/1975 | Nelson et al. | 259/4 |
| 3,949,970 A | | 4/1976 | ter Braak | 259/4 AB |
| 3,955,901 A | | 5/1976 | Hamilton | 417/395 |
| 4,358,054 A | | 11/1982 | Ehrat | 239/155 |
| 4,633,909 A | | 1/1987 | Louboutin et al. | 137/888 |
| 5,011,022 A | * | 4/1991 | Palepu et al. | 209/155 |
| 5,328,261 A | | 7/1994 | Castano | 366/102 |
| 5,371,429 A | | 12/1994 | Manna | 310/328 |
| 5,439,288 A | | 8/1995 | Hoffman et al. | 366/137 |
| 5,533,886 A | | 7/1996 | Von Der Heyde et al. | 418/1 |
| 5,597,236 A | | 1/1997 | Fasano | 366/181.5 |
| 5,664,990 A | | 9/1997 | Adams et al. | 451/60 |
| 5,709,593 A | | 1/1998 | Guthrie et al. | 451/287 |
| 5,750,440 A | | 5/1998 | Vanell et al. | 438/692 |
| 5,755,614 A | | 5/1998 | Adams et al. | 451/60 |
| 5,803,599 A | | 9/1998 | Ferri, Jr. et al. | 366/134 |
| 5,804,507 A | | 9/1998 | Perlov et al. | 438/692 |
| 5,857,893 A | | 1/1999 | Olsen et al. | 451/5 |
| 5,876,271 A | | 3/1999 | Oliver | 451/60 |
| 5,895,550 A | | 4/1999 | Andreas | 156/345 |
| 5,944,588 A | | 8/1999 | Marmillion et al. | 451/242 |
| 5,957,759 A | | 9/1999 | Cardenas et al. | 451/60 |
| 5,964,413 A | | 10/1999 | Mok | 239/223 |
| 6,102,782 A | | 8/2000 | Custer et al. | 451/67 |
| 6,290,576 B1 | * | 9/2001 | Moore et al. | 451/41 |
| 6,416,402 B1 | * | 7/2002 | Moore | 451/289 |

* cited by examiner

*Primary Examiner*—M. Rachuba
(74) *Attorney, Agent, or Firm*—Howrey Simon Arnold & White, LLP

(57) ABSTRACT

A fluid delivery line is configured to provide slurry to a planarization process, e.g., of a planarization machine. Slurry within the delivery line is provided successive forward and reverse flows. Preferably, the flow reversals are performed on a supply side of a metering pump which is used for dispensing slurry from the delivery line to a planarization pad of the planarization machine. In another embodiment, a slurry distribution system comprises a pump configured to flow slurry from a slurry reservoir to a forward delivery line. A plurality of drop lines tap into the forward line along its length. A return line returns slurry from the forward line to the slurry reservoir. A variable volume cavity is coupled in fluid communication with the return line, and is operated with plus/minus volume displacements. Additionally, a passive or active mixer may be disposed in-line with the return line and at a location between the slurry reservoir and the variable volume cavity.

118 Claims, 13 Drawing Sheets

SLURRY DELIVERY AND PLANARIZATION SYSTEMS

BACKGROUND OF THE INVENTION

The present invention relates generally to chemical mechanical planarization systems and more particularly to methods and systems for supplying slurry to a single planarization machine or to a plurality of chemical mechanical planarization machines.

In an exemplary, known chemical mechanical planarization (CMP) process, with reference to FIG. 1, surface of a semiconductor wafer 2 is positioned over a planarization pad 5 and moved relative thereto while slurry is supplied to the planarization pad. The wafer is held against the planarization pad by wafer carrier 4. Motor 6 provides rotational movement of wafer carrier 4. Planarization pad 5 is attached to platen 7, which is rotated by a second motor 9. Dispense line 8 is configured for delivering slurry to planarization pad 5. An acoustic transducer 3 is disposed near the output of dispense line 8 for breaking up particles of the slurry just prior its delivery to the planarization process.

Known, exemplary slurries typically include both chemical and mechanical components that facilitate planarization, etching or passivation of a wafer's surface. An exemplary slurry comprises an aqueous basic or acidic solution, such as aqueous potassium hydroxide (KOH), containing dispersed particles, such as silica or alumina. It is believed that if a slurry is delivered to the polishing pad during its optimal lifespan—i.e., its time window of optimal planarization effectiveness—particles of the slurry remain suspended. Accordingly, there is an aim to provide a consistent and controlled flow of slurry to the polishing pad within its optimal delivery time window.

Exemplary, prior art, slurry distribution systems are shown in FIGS. 2–4. These systems circulate slurry around a fluid loop that supplies slurry to a plurality of polishing machines. In a full-series configuration 210, with reference to FIG. 2, pump 222 pumps slurry 212 from reservoir 211, into forward line 221. A plurality of polishing machines, $\mathbf{250}_A$–$\mathbf{250}_X$, are connected in series with forward line 221. Ideally, pump 222 provides enough slurry to the distribution loop so as to maintain a return flow 225 in return line 223, despite slurry demands of the plurality of polishing machines. A known disadvantage of the full series configuration is that servicing of a single polishing machine often requires that the whole distribution loop be shut-down, thereby impacting all polishing machines along the distribution loop.

In another known configuration, with reference to FIG. 3, polishing machines $\mathbf{350}_a$–$\mathbf{350}_x$ are connected in parallel between the forward 321 and return 323 lines of the slurry distribution loop. Again, the forward 321 and return 323 lines of the distribution loop circulate slurry as provided by pump 222. Each polishing machine receives slurry from a first line 313 which is tapped into forward line 321. A second line 315 returns unused slurry, i.e., that is not taken in by a polishing machine, back to return line 323 of the distribution loop. This parallel-tap configuration 310 of FIG. 3 offers an advantage over the full-series configuration of FIG. 2. In particular, the parallel-tap configuration allows servicing of a single polishing machine, for example, $\mathbf{350}_x$, without having to terminate operation of the other machines associated with the distribution loop.

Although, not specifically shown in the illustrated drawings of the exemplary distribution loops, known fluid flow mechanisms (such as line diameters and ratio'd tap diameters and tees) can be adjusted to establish desired velocities and pressures along different regions of the distribution loop. For example, for a given line fluid flow, a decrease in line diameter can effect a greater velocity therein. Alternatively, by increasing the diameter of the line, the drop in pressure along its length can be reduced (but at the expense of fluid velocity therein). Typically, the diameter of the parallel tapped lines that couple the polishing machines to the distribution loop are kept smaller than that of the forward and return lines of the distribution loop. By keeping the diameters of the distribution loop's forward and return lines greater than the diameter of the parallel tapped lines, slurry flow favors the distribution loop. Otherwise, slurry could by-pass outer regions of the distribution loop—i.e., by flowing through a parallel tap associated with a given polishing machine—thereby depriving the more distant polishing machines of slurry solution.

Another known distribution loop comprises a simple series-tap configuration 410, as shown in FIG. 4. A plurality of polishing machines $\mathbf{450}_A$–$\mathbf{450}_X$ receive slurry from the distribution loop by way of respective drop lines 414. These drop lines 414 tap into the distribution loop at different locations 452 along its length. Pump 222 circulates slurry through the distribution loop.

Ideally, pump 222 provides a flow within the distribution loop for establishing a velocity that both replenishes slurry of the distribution line within a given time interval and assures suspension of the particles of the slurry. In the design of slurry distribution systems, a conflicting aim seeks to provide similar pressures at each drop line tap, e.g., $\mathbf{452}_A$ through $\mathbf{452}_X$. However, it is known that the greater a velocity of fluid flow within a given line, the greater the drop in pressure across its length. Accordingly, the desire to provide a rapid velocity of slurry flow within the distribution loop—i.e., so as to frequently replenish slurry and preserve suspension of particles of the slurry within the distribution line—this desire for rapid slurry velocity is set against the opposing goal of minimizing pressure drops along the length of the distribution loop.

Further referencing FIGS. 2–4, it is recognized, pursuant the present disclosure, that each drop line 214,314,414 may comprise a dead-zone region that may experience stagnant, or low velocity, conditions in accordance with the slurry demands of their respective polishing machines. For example, upon completing a planarization step, a polishing machine may terminate slurry demand. If the reduced demand ensues, agglomeration and/or precipitation of particles can result within the dead-zone regions of the drop lines.

Further illustrated in FIG. 4, relative to the planarization machine $\mathbf{450}_A$, is another, exemplary prior art re-circulation loop comprising multiple position valve 420 and re-circulation line 422. Valve 420 is disposed near the output of the dispense line. When slurry flow is discontinued to the planarization process, valve 420 is configured to route slurry into re-circulation line 422 for flowing slurry back to drop line 415. In this configuration, slurry continues circulating through the drop line and re-circulation line when slurry is not being delivered to the planarization process. It is noted, however, that when the multiple position valve 420 is configured to deliver slurry to the planarization process, slurry within the re-circulation line 422 may be stagnant.

Accordingly, there exists a need to preserve suspension of particles for slurry within slurry distribution systems, such as drop-lines, or low-flow delivery lines, as are used for delivery of slurry to chemical-mechanical planarization machines. The present invention recognizes these needs and proposes solutions thereto.

SUMMARY OF THE INVENTION

In accordance with an embodiment of the present invention, a fluid delivery line is configured to provide slurry to a polishing machine. Slurry is agitated therein by way of plus-minus slurry displacements. Preferably, the plus-minus displacements are performed on a supply side of a metering pump that is used for dispensing slurry of the delivery line to the polishing machine. More preferably, the agitating is performed when a flow of slurry to the polishing machine has been terminated. In accordance with one aspect of this embodiment, an in-line displacement moves a volume of slurry greater than that of the slurry delivery line.

In accordance with another embodiment of the present invention, a planarization apparatus comprises a dispense tube configured with an end for dispensing fluids to a planarization surface. A pump receives slurry from a drop line and is operationally configurable to pump fluid that is received from the drop line to the dispense tube. A displacement exciter is coupled to the drop line and is operationally configurable to provide plus-minus displacements of slurry within the delivery tube. In accordance with one aspect of this embodiment, the displacement exciter comprises a compressible chamber having an interior in fluid communication with the drop line.

In accordance with a further embodiment of the present invention, a slurry distribution loop comprises a fluid line that circulates slurry. A pump is configured to pump solution from a slurry reservoir to the fluid line. An output of the fluid line returns unused slurry to the slurry reservoir. A distribution tap is coupled to the fluid line for drawing-slurry therefrom. A displaceable chamber is coupled in fluid communication with the fluid line. Preferably, the slurry distribution loop further comprises a mixer, e.g., either a passive or active mixer, coupled in-line with the fluid line.

An additional embodiment of the present invention comprises a planarization apparatus having dispense line configured to supply solution to a polishing surface. A delivery line provides at least part of a fluid communication path between a slurry source and the dispense line. A fluid flow control device is configured to control a fluid flow of the fluid communication path associated with said delivery line. A variable volume chamber is coupled in fluid communication with the delivery line. In accordance with an optional aspect of this embodiment, the variable volume chamber comprises a flexible wall and a reciprocating actuator is operatively configurable to reciprocate the flexible wall. Alternatively, the slurry source comprises a variable pressure feed for altering the pressure of slurry presented to the delivery line and the variable volume chamber comprises a passive flexible or movable wall that moves or flexes responsive to pressure changes presented to the delivery line.

In accordance with another embodiment of the present invention, a slurry transport assembly for a polishing machine includes an output line configured to flow solution to the polishing machine and a slurry input line configured for receiving slurry. A multiport valve is coupled between the output line and a slurry input line. The multiport valve has an input chamber and an output chamber coupled together via a fluid communication path that can be selectively closed by a sealing member. The input chamber of the multiport valve is coupled to the slurry input line, and the output chamber is coupled to the output line which feeds the. polishing machine. In a particular embodiment, the input chamber of the multiport valve is defined, at least in part, by a movable or flexible wall. In an alternative embodiment, the input chamber comprises a fixed volume and is coupled to a remote variable volume chamber. Preferably, a rinse line is also coupled to the output chamber of the multiport valve for enabling a flow of rinse solution through the output chamber when the fluid communication path between the input and output chambers is closed by the sealing member.

Another embodiment of the present invention comprises a slurry delivery system having a conduit configured to flow slurry. A drop line taps into the conduit for obtaining slurry therefrom. Additionally, a compressible chamber is operatively coupled in fluid communication with the conduit. Preferably, the system further comprises a sensor that generates a signal in accordance with a condition of the flow of slurry within the conduit. A controller controls operation of the compressible chamber in response to the sensor's signal.

In yet another embodiment of the present invention, a slurry distribution system comprises a pump disposed between a slurry reservoir and a forward delivery line. The pump is operatively configurable to pump slurry from the reservoir to the forward line. A plurality of drop lines tap into the forward line along a length thereof. A return line returns slurry of the forward line to the slurry reservoir. A variable volume cavity is disposed in fluid communication with at least the return line, and is operable with a displaceable volume for displacing at least a partial volume of the return line. Preferably, the system further comprises one of a passive or active mixer that is coupled in-line with the return line between the slurry reservoir and the variable volume cavity.

A further embodiment of the present invention comprises a chemical mechanical polishing tool set. The tool set includes a plurality of chemical mechanical polishing machines. Conduits couple respective machines of the plurality to a slurry distribution loop for receiving. slurry therefrom. A solution modulator is coupled to the distribution loop and is operable to modulate a flow of slurry of the distribution loop.

These and other features of the present invention will become more fully apparent in the following description and independent claims, or may be learned by practice of the invention as set forth hereinafter.

BRIEF DESCRIPTION OF THE DRAWINGS

The present invention will be understood from reading descriptions of the particular embodiments with reference to specific embodiments illustrated in the appended drawings. Understanding that these drawings depict only exemplary embodiments of the invention and are not therefore to be considered limiting of its scope, the invention will be described and explained with additional detail through use of the accompanying drawings in which.

DETAILED DESCRIPTION OF THE PREFERRED EMBODIMENTS

The drawings which are referenced in the following description provide representative, non-limiting diagrams, of select embodiments of the present invention and are not necessarily drawn to scale.

The present invention relates to slurry delivery systems, and more particularly to delivery of slurry to a chemical mechanical planarization machine or to a plurality thereof.

Figure 5:
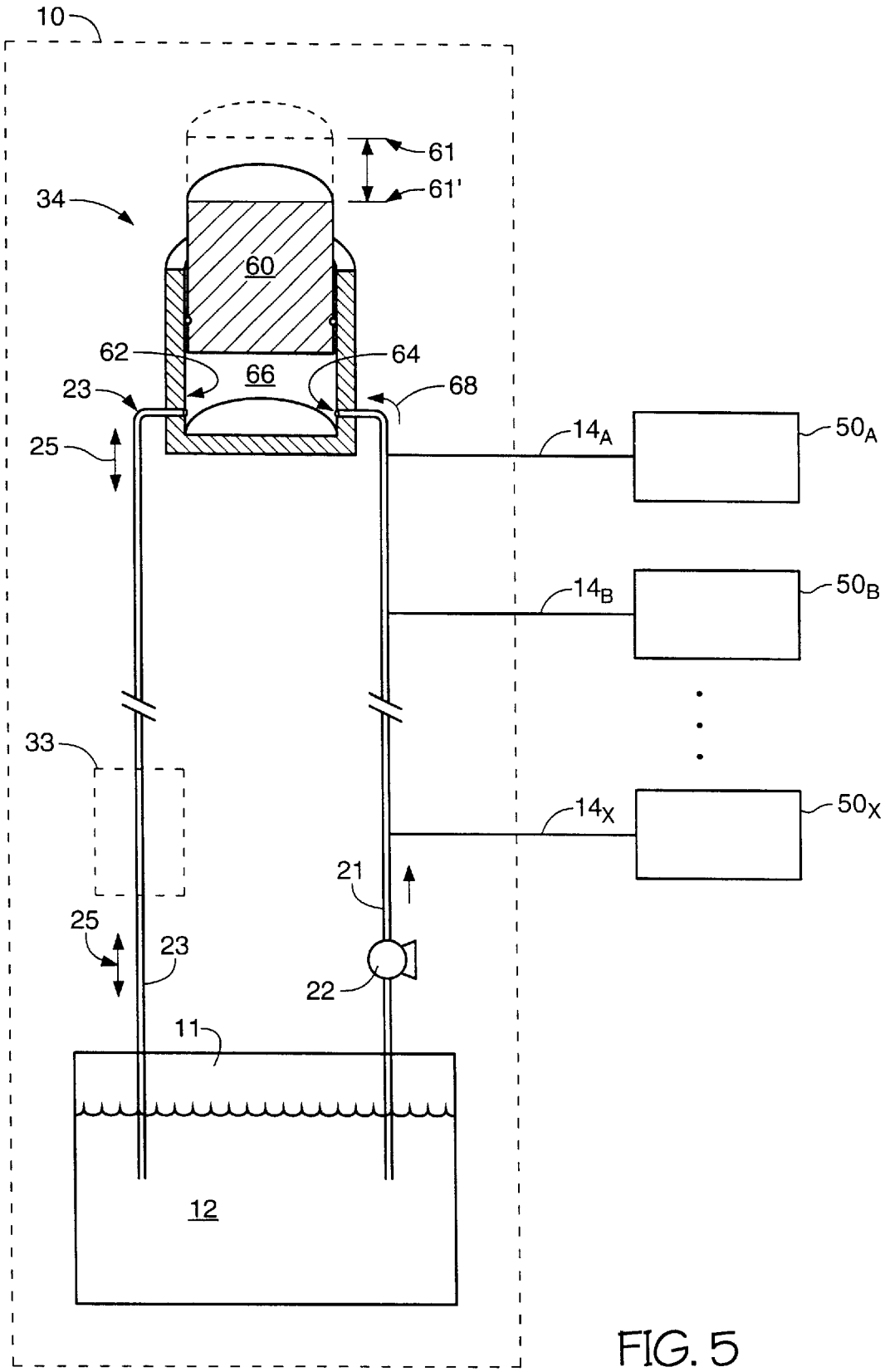
FIG. 5 is a simplified, partial cross-section, schematic diagram of a slurry distribution system of the present invention.

Referencing FIG. 5, a slurry distribution loop 10 comprises forward line 21 that receives slurry from reservoir 11 and return line 23 that returns slurry to reservoir 11. Pump 22 pumps slurry from reservoir 11 to forward line 21 of the distribution loop. A plurality of polishing machines $\mathbf{50}_A$–$\mathbf{50}_X$ are distributed along a length of the distribution loop. Drop lines 14 couple the polishing machines to the distribution loop. A variable volume chamber 34 is coupled serially within the distribution loop, preferably, between forward line 21 and return line 23. The exemplary variable volume chamber 34 of FIG. 5, is illustrated as comprising a piston in sealed, movable relationship within cylindrical walls 62 of a cylindrical housing. Input port 64 of the variable volume chamber 34 receives slurry from forward line 21, while output port 62 communicates with return line 23. In operation, withdrawal of piston 60 within the cylindrical walls expands interior 66 of the variable volume chamber. With a fixed flow of slurry from input line 21, a rate of expansion of variable volume chamber 34 affects the flow of slurry in return line 23.

For example, when piston 60 is fixed in position, the volume of chamber 34 remains constant and the flow into interior 66 from the forward line 21 at input port 64 corresponds to that flowing out and into return line 23 at output port 62. The magnitude of this flow corresponds to the flow provided by pump 22, minus the demands of the various polishing machines 50.

On the other hand, when piston 60 is moving outwardly or inwardly, the volume of interior 66 expands or contracts accordingly. Assuming a fixed flow from forward line 21, the flow of return line 23 at output port 62 is affected in accordance with the interior's rate of expansion or contraction. Furthermore, should the rate of expansion exceed the flow available at the input port, then the flow of return line 23 will reverse; thus, enabling bi-directional slurry flows 25 in return line 23. As used herein, the terms bi-directional flow, displacement or movement are meant to include characterization of sequential forward and reverse flow, displacement or movement.

Although not shown, it is understood that reservoir 11 comprises known mixing mechanics for mixing solution therein. Additionally and preferably, reservoir 11 further comprises a known bleeder valve or breathing passage that can provide atmospheric communication between the reservoir's interior atmosphere and the external atmosphere.

Further referencing FIG. 5, in accordance with an optional aspect of this embodiment of the present invention, return line 23 comprises an in-line mixer 33 disposed between variable volume chamber 34 and reservoir 11. Mixer 33 comprises a known one of either a passive or active mixer, which mixes or agitates liquids of laminar or turbulent fluid flows. A known, exemplary, passive type mixer comprises a pipe section having a series of twisted or spiral, mechanical elements that are axially nested therein. A known, exemplary, active type mixer comprises an electromechanical transducer incorporated within a tube that launches acoustic vibrations to a fluid channel therein. Such mixers are available from Sonics and Materials, Inc. of West Kenosia Avenue, Danberry, Conn. 06810, or Misonix, Inc. of, Farmingdale, N.Y., or Brantson Ultrasonics Corp., of 41 Eagle Road, Danberry, Conn.

The active mixers, in accordance with various exemplary embodiments, are operated at frequencies of sonic or ultrasonic range with power levels ranging from 5 to 500 watts. These operating parameters are adjusted in accordance with the type of slurry, the size of particles within the slurry, and the velocity of the slurry flow. Further disclosure for operation of active transducers can be found in U.S. Pat. No. 5,895,550, entitled "Ultrasonic Processing of Chemical Mechanical Polishing Slurries", which is assigned to the assignee of the present application and incorporated herein by reference.

For the exemplary embodiment of FIG. 5, variable volume chamber 34 has thus far been disclosed as comprising a piston in sealed, moveable relationship with respect to cylindrical sidewalls of a cylindrical chamber. In accordance with an alternative embodiment, variable volume chamber 34A comprises a cavity 66 which is defined at least in part by a flexible membrane 72, as shown in FIG. 6A. Membrane 72 divides housing 71 into two separate regions, i.e., interior 66 and pneumatic or hydraulic chamber 73. Input port 64 and output port 62 are coupled to respective forward 21 and return lines 23 of the distribution loop. Line 74 couples chamber 73 in fluid communication with a known pneumatic or hydraulic actuator 76. Actuator 76 is operative to displace flexible membrane 72 for sequentially compressing and expanding interior 66. With the variable volume chamber serially coupled within the slurry distribution loop, the compression and expansion operability of interior 66 likewise enables selective varying of the volume of the slurry distribution loop.

Figure 6:
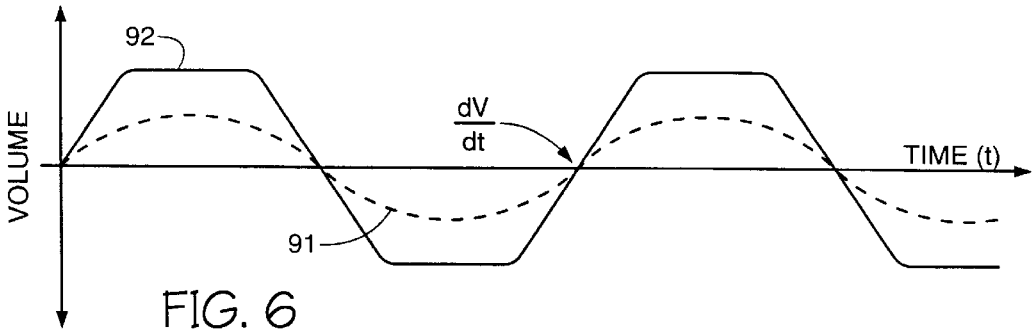
FIG. 6 is a graph showing volume displacement curves with respect to time for a variable volume chamber of the slurry distribution system of FIG. 5.
Figure 6A:
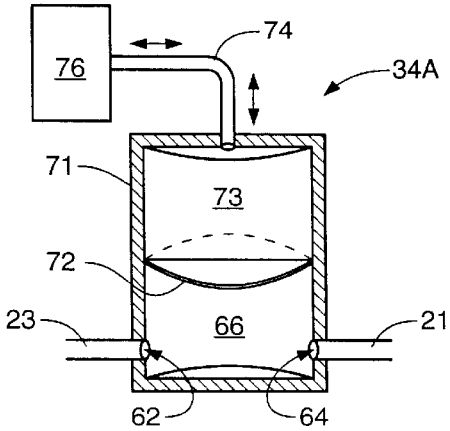
FIGS. 6A–6D are cross-sectional views of exemplary variable volume chambers of the slurry distribution system of FIG. 5.
Figure 6C:
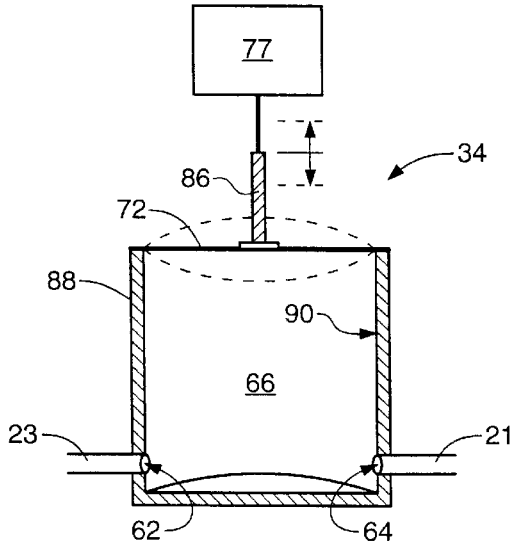

Within FIG. 6A, membrane 72 is illustrated as a singular membrane wall. Alternatively, referencing the exploded view of FIG. 6D, the flexible wall comprises two membranes 75,75' that are spaced apart from one another. Sensor 79 is coupled in fluid communication with the space that is defined between the two membranes to enable, as known in the art, determination of a membrane failure.

Figure 6B:
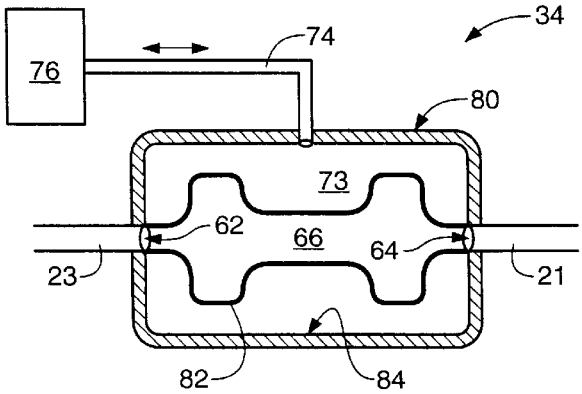
Figure 6D:
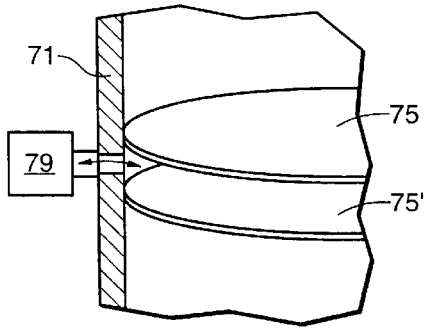

With reference to FIG. 6B, an alternative variable volume chamber 34B comprises a tubular housing 80 having nested therein an inner-tubular member 82, which is made up of a flexible membrane material. Walls of inner-tubular member 82 are spaced apart from the inside walls of tubular housing 80, thereby defining a pneumatic or hydraulic chamber 73 therebetween. The opposite ends of the inner-tubular member 82, i.e. ports 64 and 62, are coupled to the respective forward 21 and return 23 lines of the slurry distribution loop to provide interior 66 (of inner-tubular member 82) fluid communication therewith. Again, known pneumatic or hydraulic actuators couple and drive chamber 73 for providing plus-minus displacement of interior 66, and plus-minus displacement of slurry within the distribution loop.

In accordance with yet another alternative embodiment, with reference to FIG. 6C, variable volume chamber 34C comprises a housing 88 having inner walls 90 and a flexible membrane wall 72 that define interior 66. Input 64 and output port 62 couple interior 66 with respective forward 21 and return 23 lines of the slurry distribution loop. Actuator arm 86 couples flexible membrane 72 to a known displacement actuator 77, for example, such as a reciprocating motor or electromagnetic speaker coil, which actuator 77 drives arm 86 to provide plus-minus displacement of flexible membrane 72. Again, the plus-minus reciprocating displacement of membrane 72, in-turn, can provide sequential forward and reverse flows of slurry within the slurry lines of the slurry distribution loop.

Preferably, the displacement rates of variable volume chamber 34 provide at least temporary slurry velocities in return line 23 of at least three feet per second. Additionally, in an alternative embodiment, the displacement capacity of chamber 34 accommodates a volume of slurry greater than that of return line 23, wherein a full plus-minus displacement of, for example, piston 60 within the cylindrical chamber 62 (returning to the exemplary embodiment of FIG. 5) fully displaces all slurry of return line 23.

In accordance with one exemplary method of the present invention, a displacement actuator is driven to change the volume of variable volume chamber 34, such that the volume of the chamber with respect to time follows a pattern of a sinewave 91, as shown in FIG. 6. More preferably, the actuator provides abrupt volume transitions as depicted by waveform 92 of FIG. 6[D], such that the volume of the chamber with respect to time is more closely represented by a squarewave. The abrupt volume displacements represented by waveform 92 affect greater temporary velocities for the flow of a slurry within return line 23 of the distribution loop than the velocities effected by the chamber volume displacements which were represented by the sinewave.

Waveforms 91 and 92 of FIG. 6 portray displacement patterns of the variable volume chamber as following symmetrical and periodic patterns. In accordance with alternative embodiments, the displacements of the variable volume chamber with respect to time follow patterns which are non-periodic with respect to time and need not be symmetrical.

Figure 7:
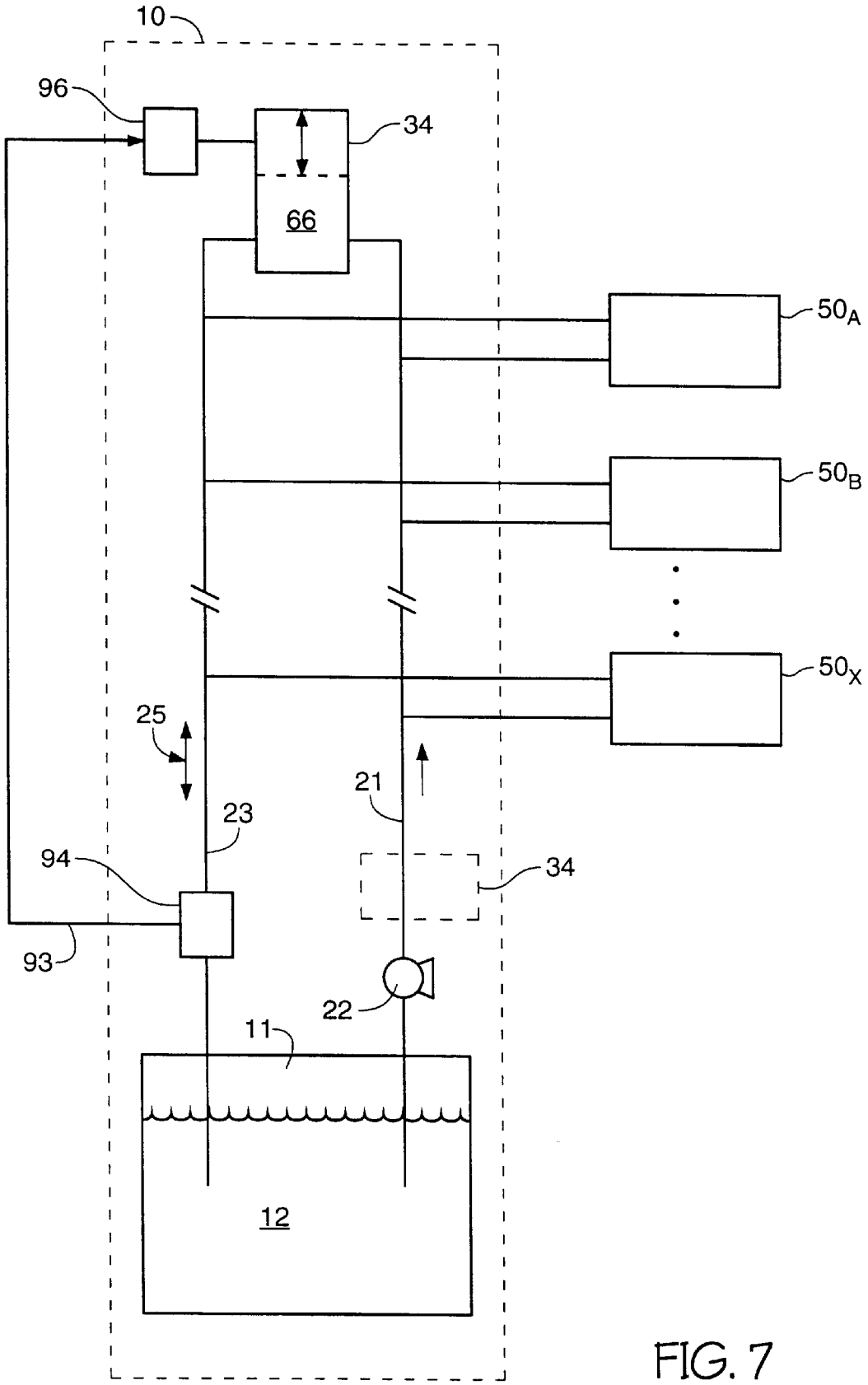
FIG. 7 is a simplified schematic diagram of a slurry distribution system in accordance with an alternative embodiment of the present invention, incorporating an optional sensor and control loop for the return line.

Moving on to FIG. 7, a preferred embodiment of the present invention comprises a sensor 94 that monitors a condition of the flow of slurry in return line 23 of distribution loop 10. Sensor 94 generates a signal 93 in accordance with, e.g., a velocity 25 of the slurry flow that passes through the return line 23. Controller 96 receives the sensor's signal 93 and drives actuator mechanics for effecting plus-minus displacement of interior 66 of variable volume chamber 34. For example, if the velocity of flow 25 exceeds a velocity of five feet per second, then actuator controller 96 upon determining the velocity can discontinue displacement of variable volume chamber 34. On the other hand, if the velocity of flow 25 drops below, for example, five feet per second, then actuator controller 96 drives displacement mechanics for providing plus-minus displacement of variable volume camber 34. Alternatively, actuator controller 96 alters at least one of the magnitude, periodicity or frequency of the displacements in accordance with the monitored condition.

Further referencing FIG. 7, polishing machines $\mathbf{50}_A$–$\mathbf{50}_X$, are coupled in parallel to distribution loop 10. Again, it is understood that known plumbing design parameters are established for the parallel paths relative to the forward and return lines of the distribution loop, for assuring that the primary flow of slurry is maintained within the distribution loop.

By way of example, assume that thirty (30) machines are coupled to the distribution loop and that each machine demands a slurry intake of X liters per minute. (For a more specific exemplary embodiment, one may assume that X is equal to 200 milliliters per minute). Pump 22 of the slurry distribution loop 10 will need to provide forward line 21 with a flow of slurry greater than 30X liters per minute. A flow greater than 30X liters per minute will assure a continued flow of slurry within the return line 23 when if all machines are operating simultaneously. However, under such condition, i.e., where all of the machines are operating simultaneously, the return line may experience a low velocity flow. Accordingly, plus-minus displacement operation of variable volume chamber 34 provides displacement excitation of slurry in return line 23 to preserve suspension of slurry particles and/or replenish the slurry therein.

On the other hand, if only one polishing machine is drawing slurry from the distribution loop, wherein the remaining machines may have their supply inputs disabled, then the velocity of slurry within the return line 25 may be at a level capable of maintaining particle suspension and replenishment of slurry therein, even without the plus-minus slurry displacements. Under these conditions, and in accordance with one exemplary embodiment of the present invention, operation of variable volume chamber 34 is adjusted to provide less than the fully available plus-minus displacements. Alternatively, the operation of variable volume chamber 34 is adjusted for a lower frequency rate or simply disabled. However, in accordance with a preferred embodiment of the present invention, operation of variable volume chamber 34 continues with at least partial displacements so as to assure replenishment of slurry in potential pockets of variable volume chamber 34.

Figure 8:
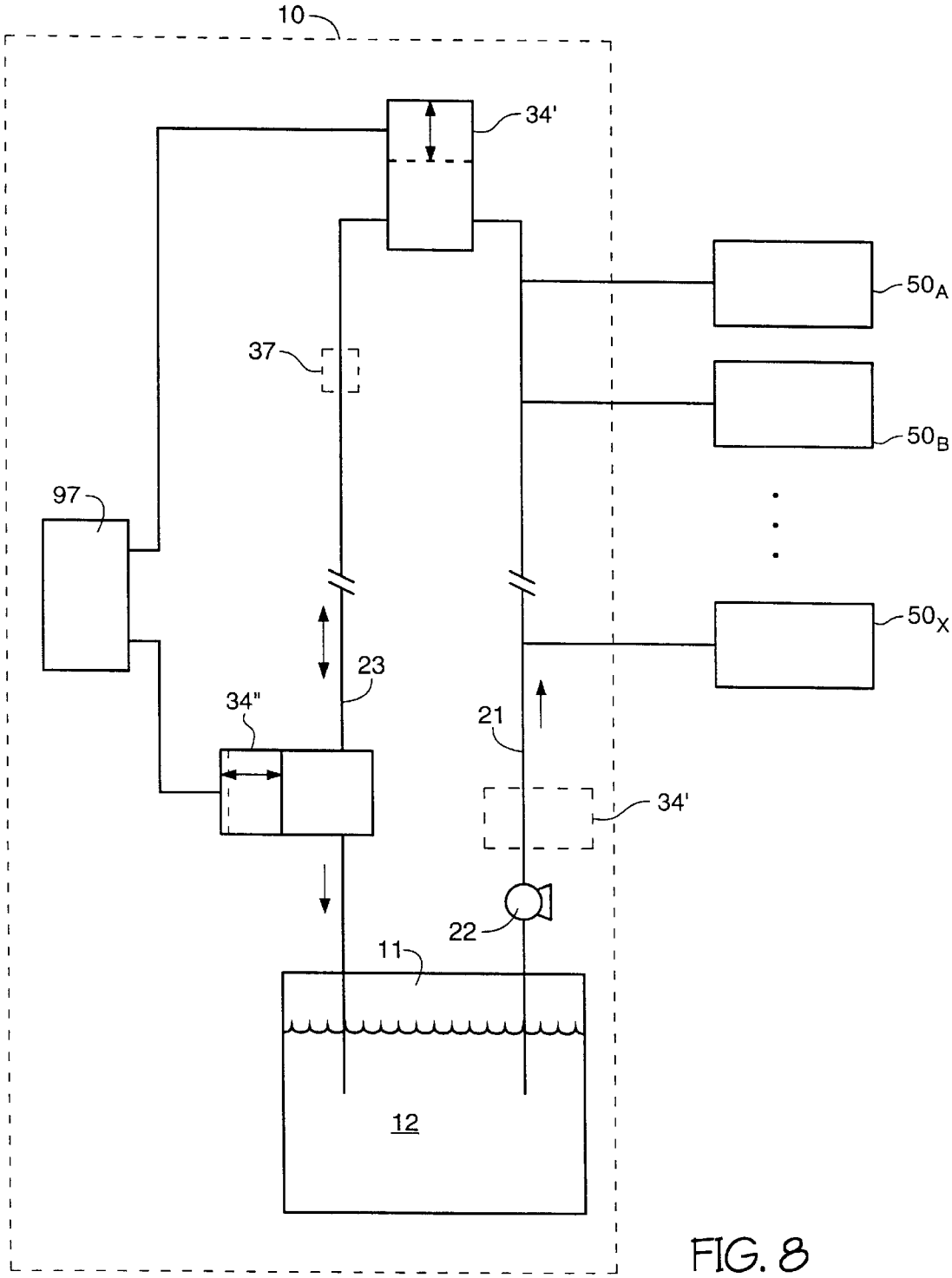
FIG. 8 is a simplified schematic diagram of a slurry distribution system in accordance with another alternative exemplary embodiment of the present invention, incorporating two variable volume chambers in a return line with an optional mixer disposed therebetween.

In accordance with an alternative embodiment of the present invention, with reference to FIG. 8, two variable volume chambers 34' and 34", are disposed near the opposite ends of return line 23. One variable volume chamber 34' is disposed at a distal end of return line 23, i.e., more distant slurry reservoir 11; while the second variable volume chamber 34" is disposed at the proximal end of return line 23, adjacent slurry reservoir 11. Actuator controller 97 drives the two separate variable volume chambers in opposite relative phase. Accordingly, when the first variable volume chamber 34' is at its maximum capacity, the second variable volume chamber 34" is at its minimum capacity. Likewise, when the first variable volume chamber 34' is at its minimum volume capacity, the second variable volume chamber 34" is at its maximum volume capacity. In this fashion, dependent upon the overall flow through the distribution loop, slurry can be exchanged between the two variable volume chambers for potentially effecting (again, dependent upon the overall forward flow) a bi-directional flow of slurry in return line 23.

Further referencing FIG. 8, an optional aspect for this exemplary embodiment of the present invention comprises mixer 37 disposed in-line with return line 23 between the first and second variable volume chambers. Similar to the mixer operation and types described earlier herein relative to the optional aspect of FIG. 5, mixer 37 (of FIG. 8) comprises one of either a passive or active type mixer and is operative to agitate solution that passes there-through. In this fashion, the mixer serves to assist preservation of particle suspension for the flow of slurry.

For the above exemplary embodiments, the variable volume chamber has been associated primarily with return line 23, i.e., disposed between the forward and return lines of the distribution loop or along the length of the return line. In accordance with an alternative exemplary embodiment, variable volume chamber 34 is disposed along the length of forward line 21, see the phantom line representations of FIGS. 6 and 7.

Thus far, the exemplary embodiments of the present invention have been directed primarily to slurry flows of the distribution loop. Transitioning hereinafter, further exemplary embodiments of the present invention address drop-lines that supply slurry and couple the distribution loop to their respective polishing machines.

Figure 4:
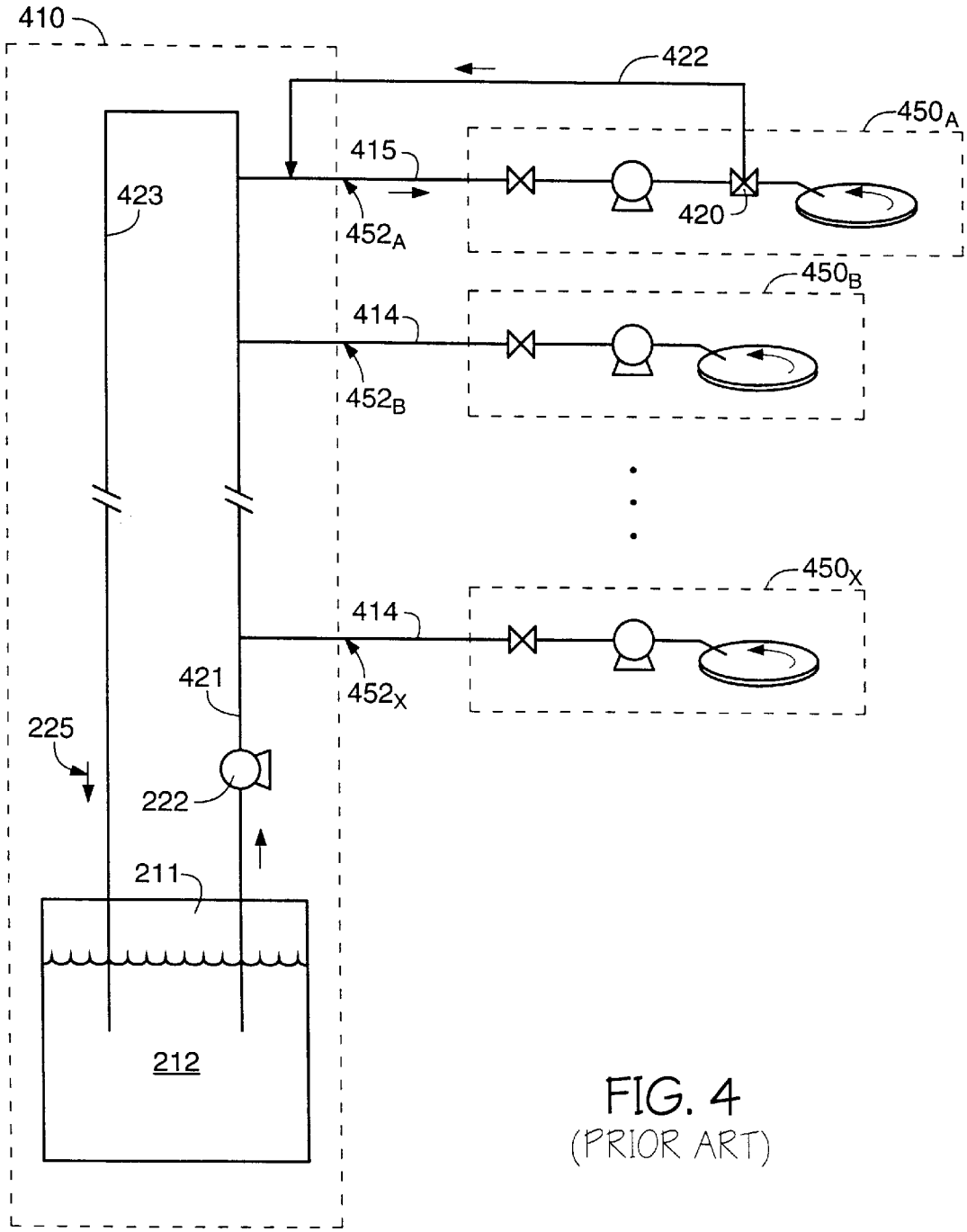
FIG. 4 (PRIOR ART)
FIG. 4 is a simplified schematic diagram representative of an exemplary prior art slurry distribution system of a series-tap configuration.
Figure 9:
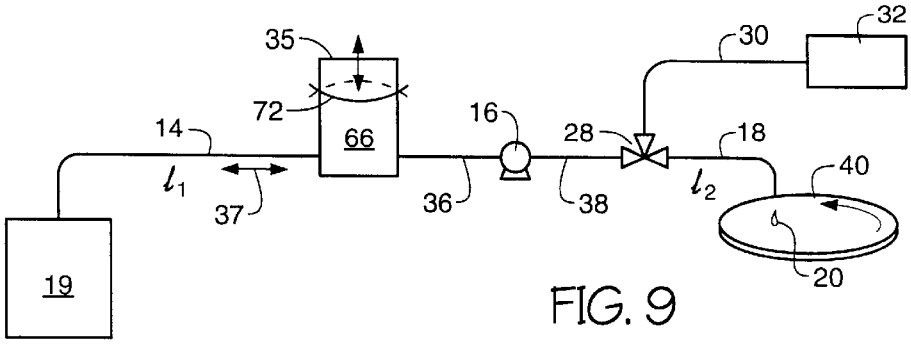
FIG. 9 is a simplified schematic diagram of a slurry delivery system and planarization apparatus in accordance with another alternative embodiment of the present invention.

As described earlier herein relative to the prior art, drop-lines 14 tap into a distribution loop for coupling and routing slurry from the distribution loop to each of the plurality of polishing machines. Dead-zone regions of these known drop lines 14, as shown in FIG. 9, may experience low flow or stagnate conditions during certain operations of the polishing machines. Alternatively, in the case of a re-circulating configuration (i.e., elements 420 and 422 of FIG. 4), stagnate conditions may exist in the re-circulating line 422 during normal delivery of slurry to a planarization process of a polishing machine. These dead-zone regions of low-flow conditions risk agglomeration of particles therein, which particles can adversely impact polishing or planarization procedures.

Figure 1:
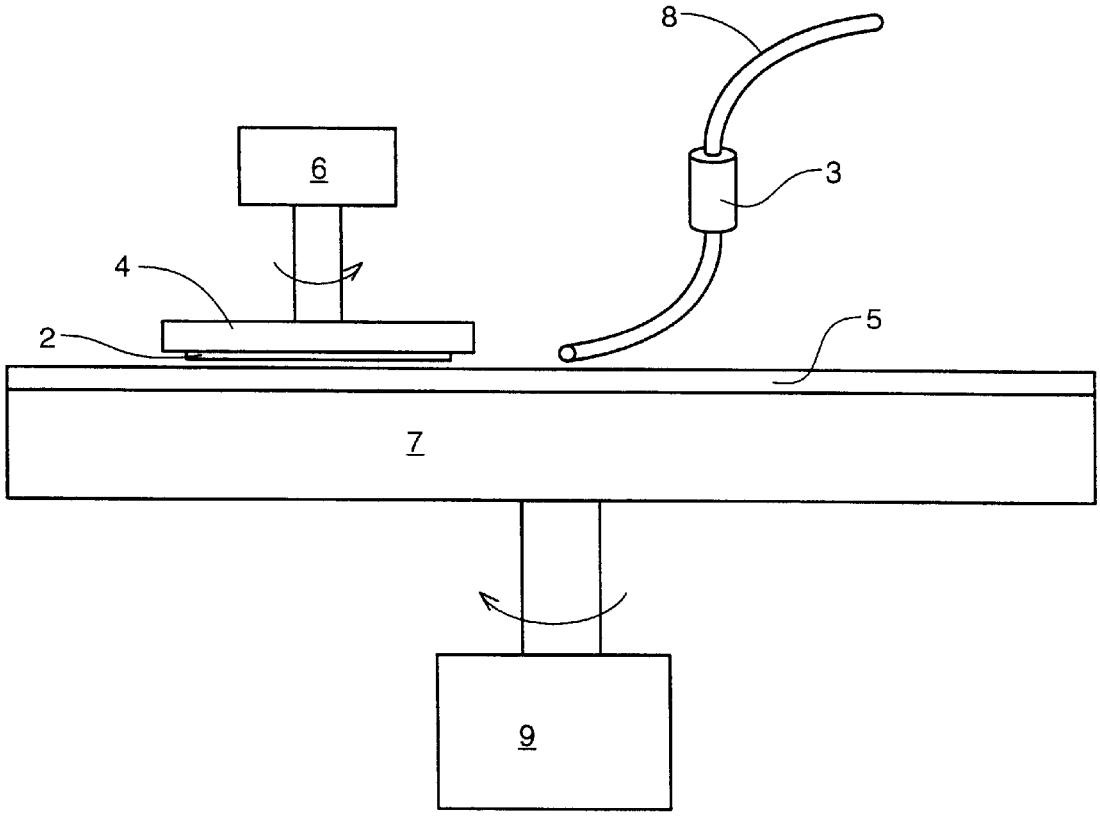
FIG. 1 (PRIOR ART)
FIG. 1 is a simplified side view representative of an exemplary prior art chemical mechanical planarization machine.
Figure 2:
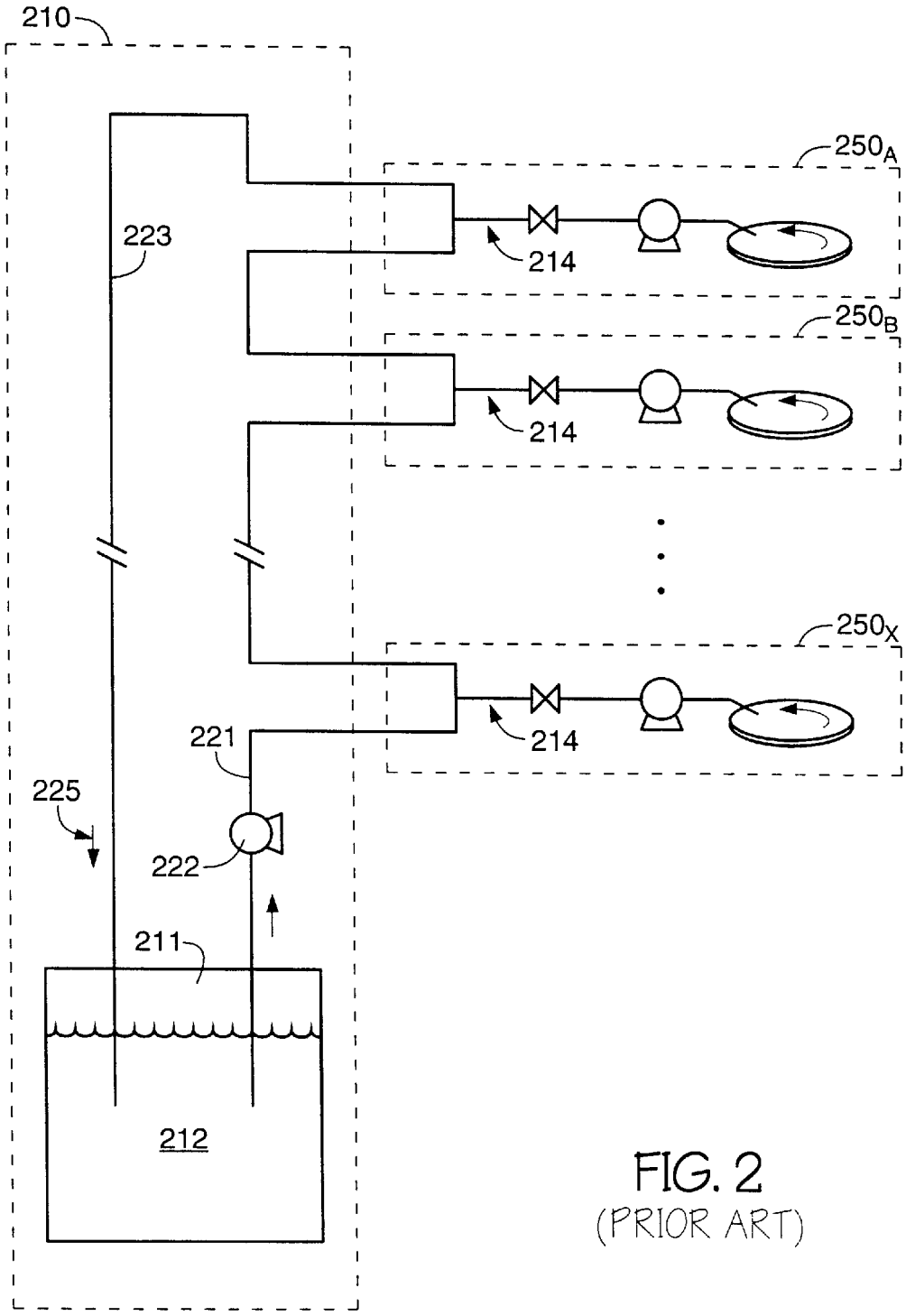
FIG. 2 (PRIOR ART)
FIG. 2 is a simplified schematic diagram representative of an exemplary prior art slurry distribution system of a full-series configuration.
Figure 3:
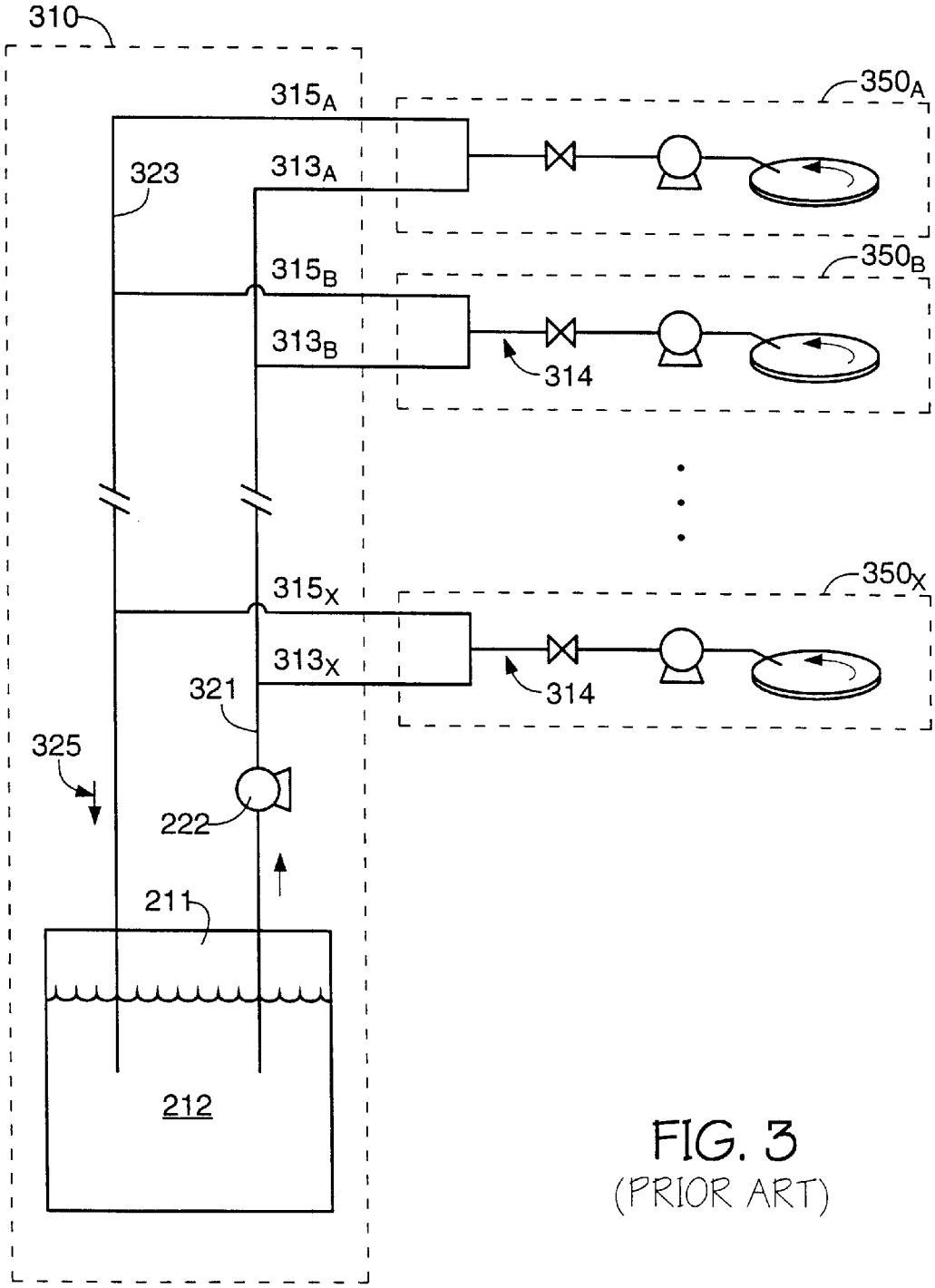
FIG. 3 (PRIOR ART)
FIG. 3 is a simplified schematic diagram representative of an exemplary prior art slurry distribution system of a parallel-tap configuration.

U.S. Pat. No. 5,895,550 recognizes a statistical distribution of undesirably large particles in slurry of known polishing procedures, and further discloses an acoustic transducer 3, turning back with reference to FIG. 1, coupled in-line and next to the output of dispense line 8. Although, recognizing the presence of large particles within the slurry; U.S. Pat. No. 5,895,550 does not fully address the dead-zone regions of drop-lines, re-circulation lines or of slurry distribution systems as provided by way of the present invention.

In accordance with another exemplary embodiment of the present invention, moving forward with reference to FIG. 9, variable volume chamber 35 is positioned in fluid communication with drop line 14 to provide plus-minus displacement of slurry within the drop line. A known polishing apparatus receives slurry from drop-line 14 via variable volume chamber 35. Simplistically illustrated in FIG. 9, an exemplary polishing apparatus is shown as comprising dispense line 18 positioned for delivering solutions, for example, slurry as represented by drop 20, to the polishing surface of planarization pad 40. It is understood that this depiction of solution delivery to the planarization pad represents a simple, exemplary method of solution delivery, and that the scope of the present invention is not necessarily limited to this particular configuration for delivering slurry to the planarization pad. For example, another known configuration (not shown) includes a network of tunneling channels within a platen located beneath the planarization pad.

Continuing with reference to FIG. 9, multi-position valve 28, for example, a three-way valve, couples to an input of dispense line 18. Multi-position valve 28 enables selective delivery of solution to dispense line 18 as provided from one of either pump 16 or an alternative solution source 32. In accordance with a preferred embodiment of the present invention, the alternative solution source comprises a source of deionized water. The alternative solution source is coupled to valve 28 by way of tube 30. Pump 16 is coupled to the slurry input of multi-position valve 28 by way of line 38. Multi-position valve 28 comprises, for example, a known one of either a manually or a remotely operable valve. Variable volume chamber 35 is coupled between pump 16 and drop line 14. In operation, plus-minus displacement operation of variable volume chamber 35 provides bi-directional movement of slurry through drop line 14, and to-from slurry source 19.

In accordance with one exemplary embodiment, slurry source 19 comprises a simple slurry reservoir which feeds the input of drop line 14. Alternatively, slurry source 19 comprises a slurry distribution loop equivalent to one of the distribution loops as were described previously herein. Additionally, variable volume chamber 35, which is coupled to drop line 14, may comprise a chamber of a type equivalent to one of the types characterized previously herein relative to FIGS. 5, [5]6A–[5C]6D. However, the variable volume chamber 35 associated with drop[–] line 14 typically has a capacity less than that of the variable volume chambers 34 as were described earlier herein relative to the exemplary embodiments of the slurry distribution loop.

Further referencing FIGS. 8 and 9, multi-position valve 28 comprises a three-way valve which is normally configured for supplying slurry through dispense line 18 and to the polishing surface of planarization pad 40. Preferably, pump 16 comprises a peristalic pump that provides metered or meter controlled slurry flow. Exemplary peristalic pumps, and flexible tubing for known use therewith, are available from Cole-Parmer of Vernon Hills, Ill. under the trademark Masterflex®. During the polishing procedure, pump 16 pulls polishing solution through dropline 14 and forwards such slurry through valve 28, through dispense line 18 and to planarization pad 40. While pump 16 pumps the polishing solution to polishing pad 40, variable volume chamber 35, in a preferred embodiment, continues to provide plus-minus displacement agitation of slurry within drop-line 14. Upon completing a particular polishing procedure, the polishing machine may disable pump 16 and terminate slurry flow. Additionally, multi-position valve 28 is then configured for channeling a rinse solution, such as deionized water or a buffer solution, to the dispense line 18 and to polishing pad 40 for cleaning or conditioning the surface of planarization pad 40. While pump 16 is disabled, variable volume chamber 35 is driven to provide plus-minus displacement of slurry solution in drop line 14.

Figure 10:
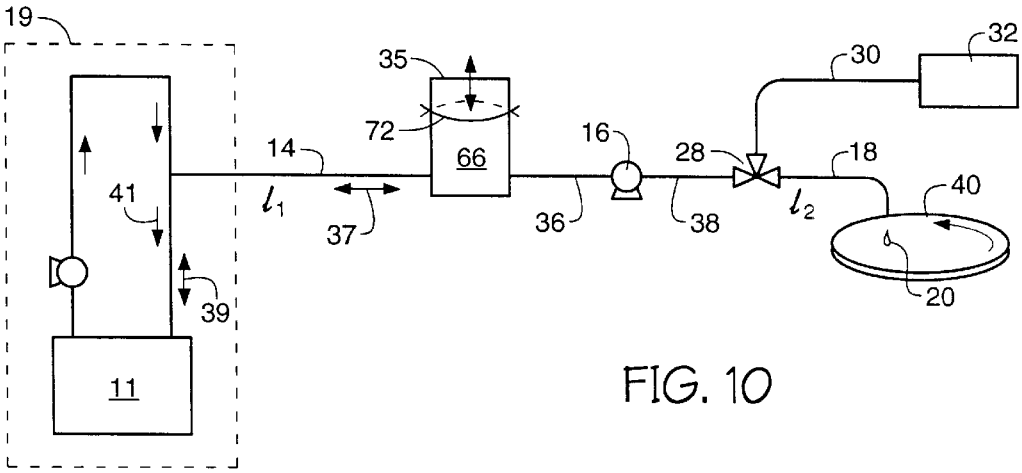
FIG. 10 is a schematic diagram of a slurry delivery system in accordance with an alternative embodiment of the present invention, incorporating a slurry distribution loop as a slurry source.

FIG. 10 represents an alternative embodiment of the present invention, corresponding to that of FIG. 9, wherein slurry source 19 comprises a slurry distribution loop. Bi-directional slurry flow 37 within drop line 14 is shown as also effecting a bi-directional flow 39 in the distribution loop. It is also understood that the bi-directional displacement of solution within delivery line 14 typically modulates a forward flow 41 of solution within a distribution loop.

Figure 11:
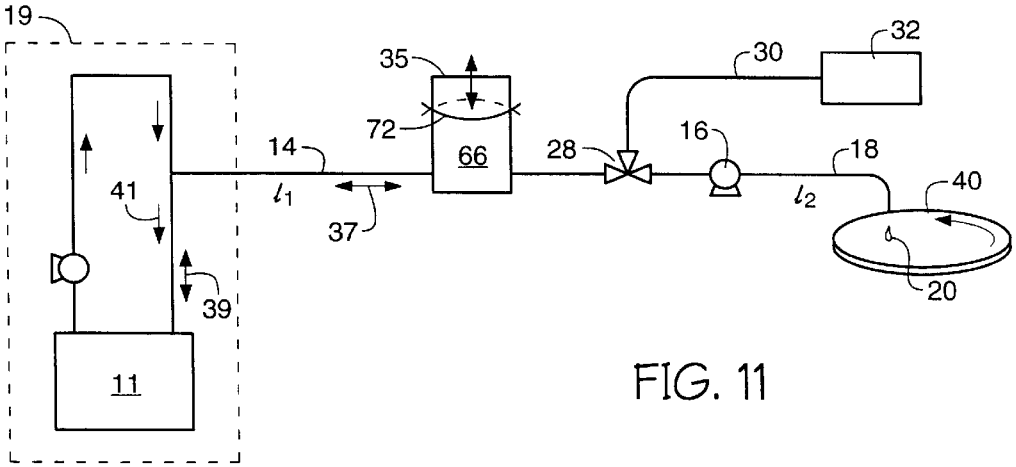
FIG. 11 is a simplified schematic diagram of a slurry delivery system in accordance with an alternative embodiment of the present invention, employing a pump placement beyond the multi-position valve of the delivery line.

In accordance with an alternative embodiment of the present invention, with reference to FIG. 11, pump 16 is positioned within the solution path on the down stream side of multi-position valve 28. Variable volume chamber 35 is positioned within the slurry line up-stream and adjacent multi-position valve 28. Accordingly, after the polishing machine has completed a particular polishing step, multi-position valve 28 may be configured to terminate the flow of polishing solution and to start a flow of rinse solution through pump 16, dispense line 18 and onto polishing pad 40. Again, variable volume chamber 35 is operated to provide a bi-directional flow of slurry in drop line 14.

Typically, dispense line 18 comprises a tube, for example, of about 24 to 28 inches in length $l_2$ with a nozzle attached to its distal end proximate the polishing pad for delivering solution thereto. Additionally, drop line 14 comprises a hose or tube, for example, of a length $l_2$ of about 10 to 20 feet. In a particular, exemplary embodiment of the present invention, the displacement agitator or variable volume chamber 35 has a displaceable volume greater than that of drop line 14. Alternatively, the displaceable volume is less than that of delivery line 14.

Figure 12:
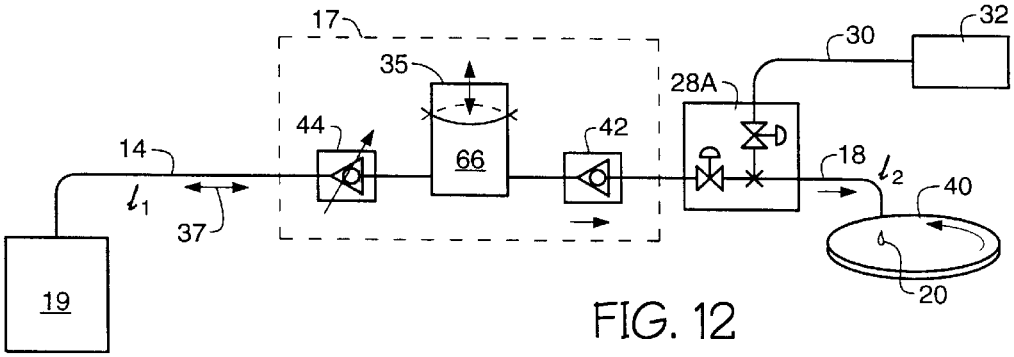
FIG. 12 is a simplified schematic diagram of a slurry delivery system in accordance with an alternative embodiment of the present invention, incorporating a diaphragm pump having a leaky check valve.

In accordance with another exemplary embodiment of the present invention, with reference to FIG. 12, a polishing machine comprises a drop line 14 coupled to pump 17. Multi-position valve 28A is positioned between pump 17 and dispense line 18. The inner details illustrated for multi-position valve 28A merely portray an exemplary configuration for the valve; other known configurations are also available for realization of such multi-position valve 28A. Dispense line 18 is configured to receive solution from valve 28A and to deliver the solution to planarization pad 40. A second input of multi-position valve 28 is coupled to an alternative solution source 32 by way of tube 30. In this particular embodiment, pump 17 comprises a diaphragm pump; wherein a diaphragm defines, at least in part, an interior 66 of a variable volume chamber 35 that is disposed between input and output check-valves 44 and 42 respectively. During normal slurry delivery to dispense line 18, multi-position valve 28 is configured for supplying slurry from pump 17 to dispense line 18. Variable volume chamber 35 is operative to provide plus/minus slurry displacements to advance slurry through respective check-valves 44 and 42. For example, during an up-stroke of the diaphragm, slurry will flow into an expanding interior 66 of variable volume chamber 35 via input check-valve 44. During a down-stroke of the diaphragm, slurry is displaced away from variable volume chamber 35 through check valve 42. Upon completing a particular polishing step, multi-position valve 28 is configured for supplying an alternative solution, i.e., a buffer or deionized water, as a rinse solution through dispense line 18 and a forward flow of slurry through pump 17 is terminated. Check valve 44 is set to be fully or partially disabled so that continued plus/minus displacement of the diaphragm provides full, or at least partial, backflow through check valve 44—thereby effecting a bi-directional flow of slurry in drop line 14.

Figure 13:
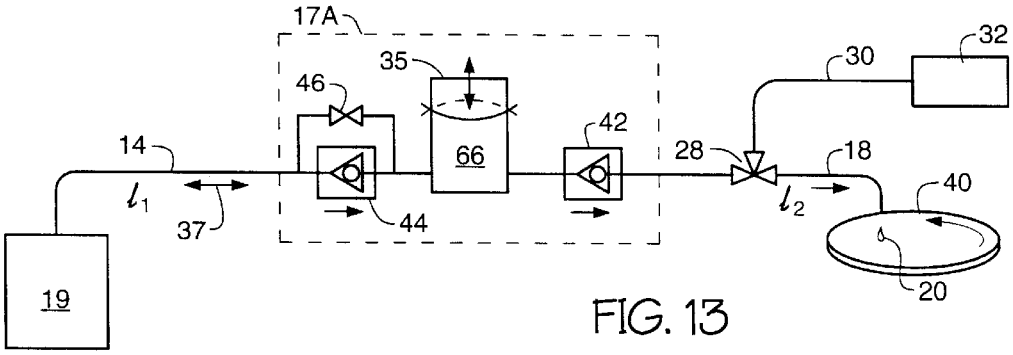
FIG. 13 is a simplified schematic diagram of a slurry delivery system in accordance with another alternative embodiment of the present invention, incorporating a valve disposed in parallel with a check valve of a diaphragm pump.

In accordance with an alternative embodiment, referencing FIG. 13, a by-pass valve 46 is configured around check valve 44. During normal operation of pump 17A, by-pass valve 46 is turned off and a forward flow of slurry is provided to planarization pad 40. When slurry flow to planarization pad 40 has been terminated, the by-pass valve is enabled and operation of variable volume chamber 35 funnels solution through bypass valve 46 so as to provide plus/minus displacement of slurry within drop line 14.

Figure 14:
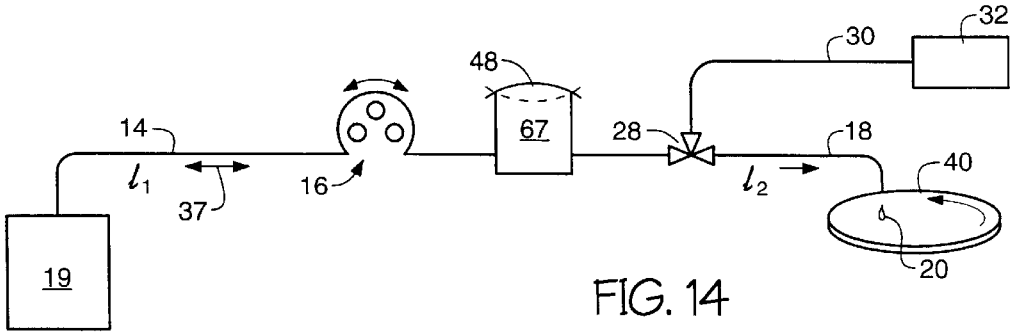
FIG. 14 is a simplified schematic diagrain of a slurry delivery system in accordance with an additional alternative embodiment of the present invention, incorporating a variable volume chamber disposed between a multi-position valve and metering pump operable bi-directionally.

In accordance with yet another embodiment of the present invention, with reference to FIG. 14, a metering pump 16, for example, a peristalic pump, is operated bi-directionally for providing plus/minus displacement of slurry within drop line 14. A passive membrane chamber 48 is disposed between the bi-directional metering pump 16 and multi-position valve 28. In accordance with a particular exemplary embodiment, passive membrane chamber comprises simply a piece of flexible, elastomeric tubing. During normal operation, multi-position valve 28 is configured for supplying slurry from delivery line 14 to dispense line 18 and pump 16 operated in a forward fashion for supplying a flow of slurry to planarization pad 40. Once a particular polishing step has been completed, slurry delivery to planarization pad 40 is terminated and multi-position valve 28 configured for flowing a rinse solution to planarization pad 40. Upon terminating slurry flow to the planarization pad, peristalic pump 16 is operated bi-directionally for effecting plus/minus displacement of slurry through drop line 14. Passive chamber 48 is provided between pump 16 and multi-position valve 28 in order to accommodate the plus/minus solution displacements effected by pump 16.

Figure 15:
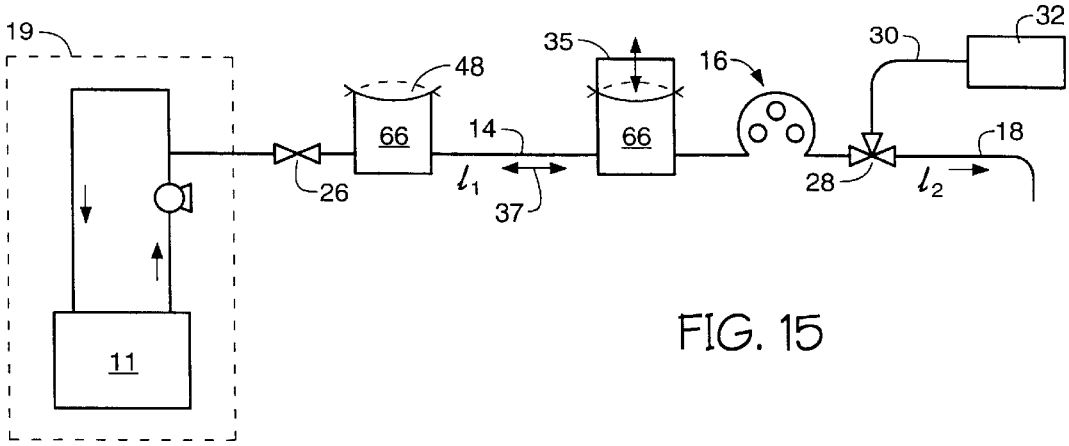
FIG. 15 is a simplified schematic diagram of a slurry delivery system in accordance with an alternative exemplary embodiment of the present invention, incorporating both an active variable volume chamber and a passive variable volume chamber.

A further embodiment of the present invention, with reference to FIG. 15, comprises active displacement chamber 35 and passive chamber 48 disposed on opposite ends of drop line 14. Valve 26, which is positioned between slurry source 19 and drop line 14, can be turned off for terminating a flow of slurry to the planarization process. When the flow of slurry to the polishing machine is terminated, a known reciprocating actuator (not shown) modulates the volume of the interior 66 of variable volume chamber 35, so as to effect a bi-directional flow 37 of solution through drop line 14. With valve 26 disabled, bi-directional flow 37 is facilitated by passive chamber 48, rather than flowing to/from slurry source 19. Accordingly, slurry which has already been delivered to drop line 14 will remain isolated from slurry source 19.

Figure 16:
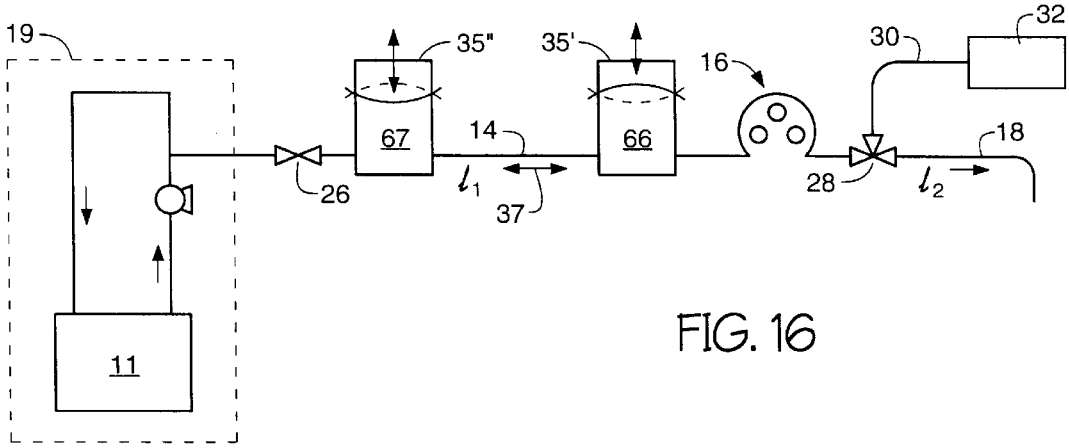
FIG. 16 is a simplified schematic diagram of a slurry delivery system in accordance with an alternative exemplary embodiment of the present invention, incorporating two active variable volume chambers.

In accordance with another alternative embodiment, with reference to FIG. 16, a controller operates the reciprocating actuators (not shown) of respective first and second displacement chambers 35' and 35" so as to compress them in opposite phase relationship. In other words, when chamber 35' is being compressed, chamber 35" is left alone and allowed to expand. Likewise and during an opposite phase, when chamber 35" is being compressed, chamber 35' is left alone and allowed to expand.

Figure 17:
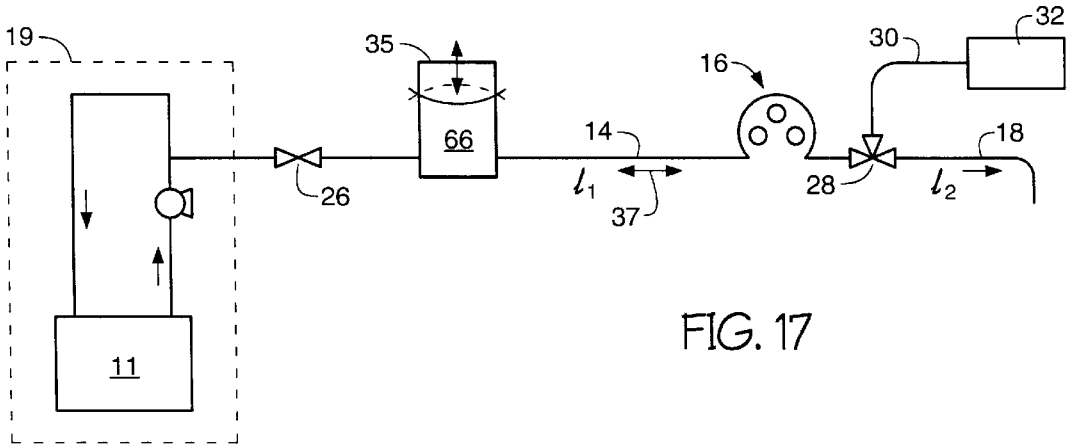
FIG. 17 is a simplified schematic diagram of a slurry delivery system in accordance with another exemplary, alternative embodiment of the present invention, incorporating a valve and a single active variable volume chamber.

In yet a further embodiment of the present invention, with reference to FIG. 17, variable volume chamber 35 is coupled to the input side of drop line 14, proximate slurry source 19. Additionally, valve 26 is positioned between the displacement chamber 35 and slurry source 19. When slurry flow is discontinued to the planarization pad of the polishing machine, pump 16 is turned-off. For this particular exemplary embodiment, pump 16 comprises a peristalic pump, for example, such as those available under the tradename of Masterflex®. The peristalic pump is equipped with flexible tubing that is capable of accommodating small volume changes. Accordingly, variable volume chamber 35 is operated to provide small volume displacements that can be accommodated by the flexible tubing at the input of peristalic pump 16 positioned on the opposite end of drop line 14. Preferably, the moveable wall of chamber 35 is actuated by a high frequency reciprocator—e.g., such as a known acoustic or ultrasonic frequency electromagnetic speaker coil or the like—which is capable of providing volume changes to chamber 35 for displacing slurry within drop line 14.

Figure 18:
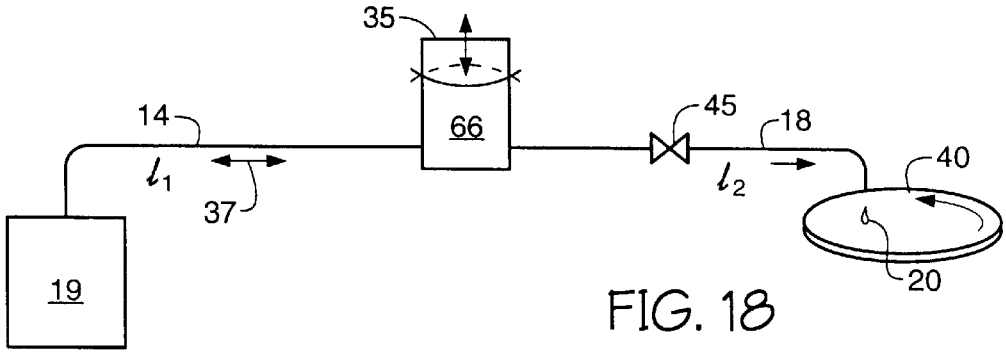
FIG. 18 is a simplified schematic diagram of a slurry delivery system in accordance with an alternative exemplary embodiment of the present invention, incorporating a flow control device and an active variable volume chamber.

In accordance with a further exemplary embodiment of the present invention, referencing FIG. 18, the drop line 14 that is directed to the polishing machine is coupled in series with valve 45 which is located proximate dispense line 18. Slurry source 19 includes a pressurized feed for establishing a flow to the polishing machine when valve 45 is open. When valve 45 is closed and the slurry flow is terminated to the polishing machine, active variable volume chamber 35, which is also couple in series, fluid communication with the drop line 14, proximate valve 45, this variable volume chamber is actuated so as to alter its internal volume 66 for reciprocating slurry within the drop line in both forward and reverse directions to and from slurry source 19. Alternatively, referencing FIG. 19, slurry source 19 can modulate its pressure feed for effecting slurry displacement to and from a passive variable volume chamber 48.

Figure 19:
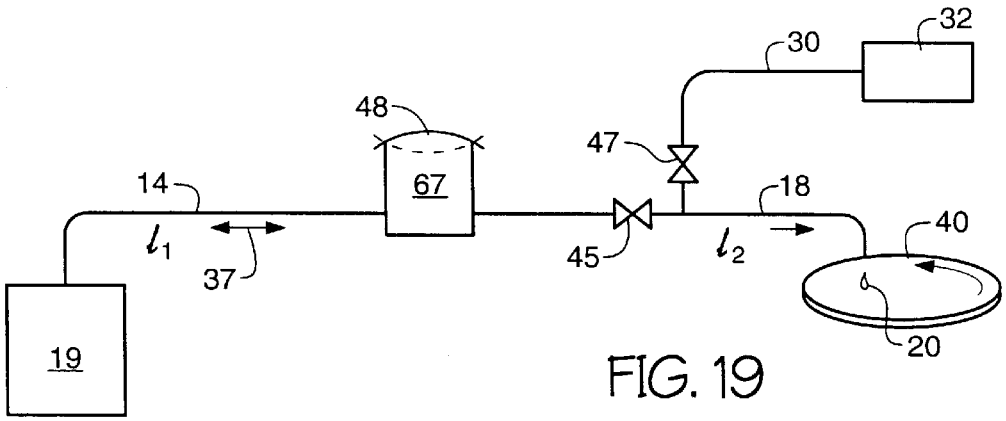
FIG. 19 is a simplified schematic diagram of a solution delivery system in accordance with another exemplary embodiment of the present invention, incorporating a variable volume chamber in combination with a slurry source that has a variable pressure feed.

Further shown in FIG. 19, an alternative solution (e.g., rinse solution) can be fed, when valve 45 has been shut, from alternative solution source 31 to dispense line 18 via line 30 and valve 47.

In connection with valve 45 and variable volume chamber 48, a further potential limitation is recognized by the present disclosure. In particular, it is further theorized that a residual dead zone region may exist between chamber 48 and valve 45, and also at the input chamber of valve 45. These dead zone regions, although smaller than those addressed earlier herein, these stagnate regions likewise risk a possibility of undesirable slurry agglomeration and/or precipitation.

Figure 20:
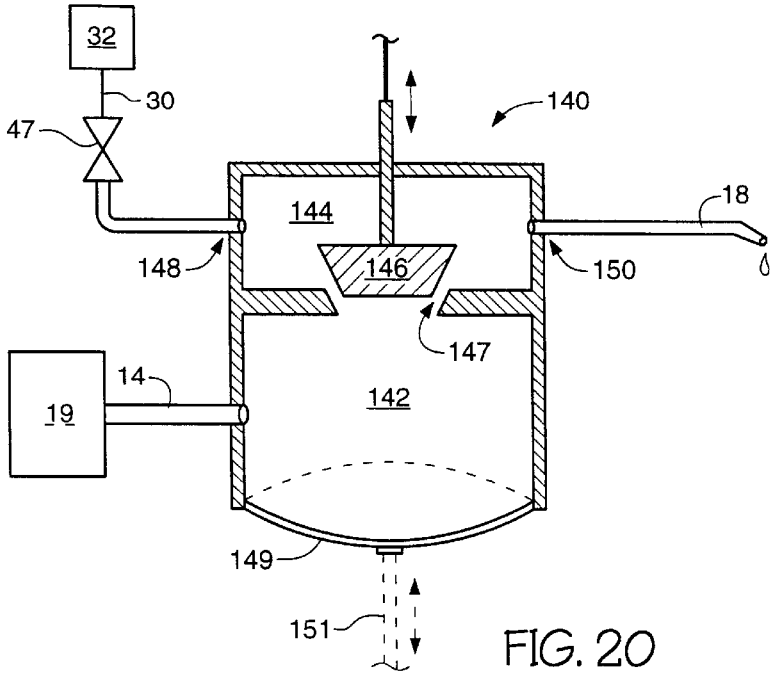
FIG. 20 is a simplified schematic diagram of a solution delivery system in accordance with further exemplary embodiment of the present invention, incorporating a multiport valve that has an input chamber defined in part by a moveable or flexible wall.

Addressing this further identified risk, in accordance with another embodiment of the present invention, with reference to FIG. 20, a multiport valve 140 is coupled in fluid communication between drop line 14 and dispense line 18. The valve comprises an input chamber 142 which is defined in part by a moveable wall 142. Valve 146 is selectively operable to separate output chamber 144 from input chamber 142 when the valve is seated within valve seat 147, thereby closing the passage between the two chambers. Drive mechanics or springs, which are well known in the art, are not illustrated for purposes of simplifying illustration and discussion of the multiport valve 140.

An input 148 to the output chamber 144 of multiport valve 140 is coupled to the alternative solution source 31 (rinse solution) via line 30 and valve 47. The output port 150 of the output chamber 144 is coupled to distribution line 18 for feeding solution to a polishing machine. In operation, multiport valve 140 is opened by lifting valve (or stopper) 146 from its valve seat 147, and permitting slurry solution to flow—i.e., from slurry source 19, through drop line 14, input chamber 145 and output chamber 144, and through dispense line 18 for delivery to a polishing process. In this system configuration, valve 47 is typically kept closed for preventing the alternative solution (i.e., rinse solution) from mixing with the slurry that is being delivered to the polishing process.

Once a polishing step has been completed at the polishing machine, multiport valve 140 closes the slurry passage by seating the valve plug or stopper 146 against its valve seat 147, so as to isolate its input chamber 142 from the output chamber 144. Next, valve 47 is opened for allowing rinse solution to flow through the output chamber 144 of the multiport valve and into dispense line 18. Slurry source 19, if it includes a variable pressure feed, is then operated for modulating its pressure which in turn will reciprocate the flexible wall of the input chamber 142 for modulating its internal volume and displacing, in both forward and reverse directions, slurry within drop line 14. Alternatively, the flexible wall 149 is driven by a reciprocating actuator 151.

Figure 21:
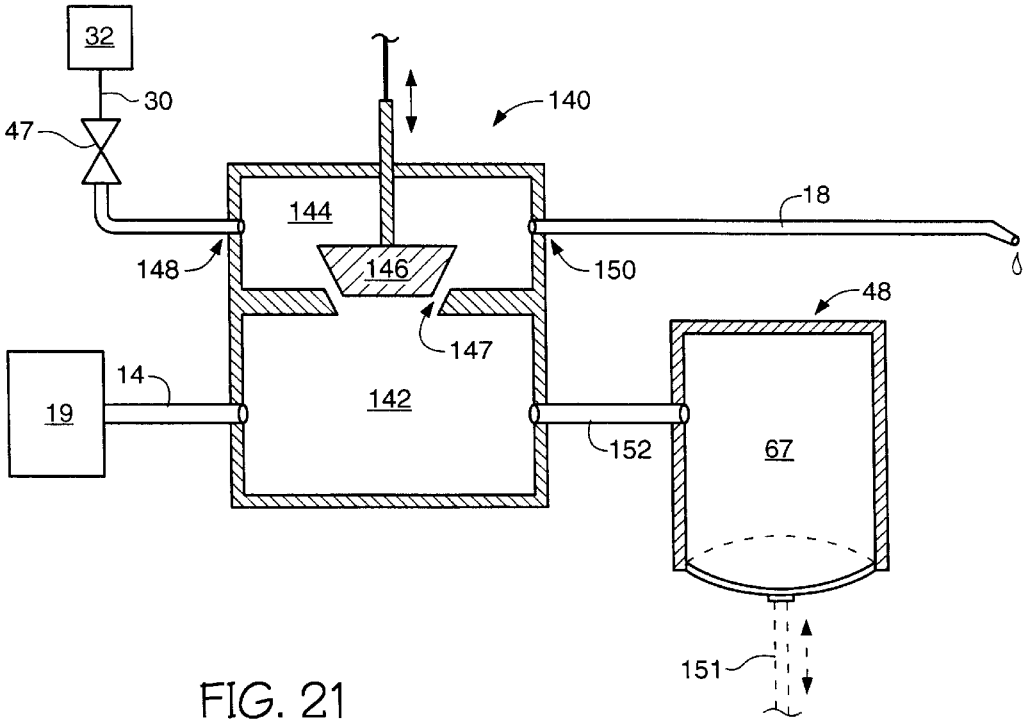
FIG. 21 is a simplified schematic diagram of a solution delivery system in accordance with yet another exemplary embodiment of the present invention, incorporating a multiport valve in combination with a variable volume chamber that is coupled to the input chamber of the multiport valve, wherein the first chamber of the multiport valve is disposed serially between the variable volume chamber and the source of slurry.

In accordance with an alternative aspect of this exemplary embodiment of the present invention, with reference to FIG. 21, input chamber 142 comprises an output line 152 that is coupled to an external variable volume chamber 48. Exemplary illustration and further description of an exemplary multiport valve may be found in U.S. patent application Ser. No. 09/055,348, filed Apr. 4, 1998, now U.S. Pat. No. 6,102,782 issued Aug. 15, 2000, which is owned in common by the assignee of the present application, and hereby incorporated by reference. Continuing with reference to FIG. 21, when slurry flow is terminated to the polishing machine, slurry is displaced in both forward and reverse directions through drop line 14, input chamber 142 and line 152 as driven by a modulating pressure feed of slurry source 19, or alternatively, as driven by a reciprocating actuator 151 that is coupled to the flexible wall of variable volume chamber 48.

Accordingly, the present invention provides new assemblies and methods for supplying slurry to a polishing machine or a plurality of polishing machines. Although, the forgoing invention has been described with reference to certain exemplary embodiments; other embodiments will become apparent in view of this disclosure. Therefore, the described embodiments are to be considered only as illustrative and not restrictive. The scope of the present invention, therefore, is indicated by the appended claims and their combination in whole or in part rather than by the forgoing description. All changes thereto which come within the meaning and range of the equivalence of the claims are to be embraced within their scope.

What is claimed is:

1. A polishing apparatus, comprising:

a conduit capable of flowing a slurry; and a slurry displacer coupled to the conduit capable of imparting plus-minus movement to the slurry when engaged, wherein the plus-minus movement is relative to the flow, if any, of slurry within the conduit.

2. The polishing apparatus of claim 1, wherein the slurry displacer comprises a variable volume chamber, and wherein varying the volume of the variable volume chamber imparts the plus-minus movement to the slurry.

3. The polishing apparatus of claim 2, further comprising a piston capable of varying the volume in the variable volume chamber.

4. The polishing apparatus of claim 2, further comprising a flexible wall capable of varying the volume in the variable volume chamber.

5. The polishing apparatus of claim 4, further comprising an actuator arm coupled to the flexible wall.

6. The polishing apparatus of claim 2, further comprising two flexible walls capable of varying the volume of the variable volume chamber, and further comprising a sensor in communication with a space between the two flexible walls to detect flexible wall failure.

7. The polishing apparatus of claim 2, further comprising a system in communication with the variable volume chamber to vary the volume of the variable volume chamber, and wherein the system is hydraulic or pneumatic.

8. The polishing apparatus of claim 1, further comprising a controller for sensing a quantity of slurry flow in the conduit, and wherein the controller engages the slurry displacer in response to the quantity of slurry flow.

9. The polishing apparatus of claim 1, wherein the conduit comprises a forward line capable of supplying slurry from a slurry reservoir to a polishing machine.

10. The polishing apparatus of claim 1, wherein the conduit comprises a return line capable of supplying slurry from a polishing machine to a slurry reservoir.

11. The polishing apparatus of claim 1, wherein the conduit comprises a drop line capable of flowing a slurry to a polishing machine.

12. The polishing apparatus of claim 11, further comprising a valve for directing slurry through the drop line.

13. The polishing apparatus of claim 11, wherein the drop line has an end in communication with the polishing machine, and wherein the valve is placed closer to the polishing machine than is the slurry displacer.

14. The polishing apparatus of claim 13, wherein the slurry displacer is engaged when the valve is closed.

15. The polishing apparatus of claim 11, further comprising a multi-position valve for connecting an alternative solution source to the drop line, wherein the multi-position valve is capable of flowing either the alternative solution or the slurry to the polishing machine.

16. The polishing apparatus of claim 15, wherein the drop line has an end in communication with the polishing machine, and wherein the multi-position valve is placed closer to the polishing machine than is the slurry displacer.

17. The polishing apparatus of claim 1, further comprising an engageable slurry pump capable of pumping slurry through the conduit.

18. The polishing apparatus of claim 17, wherein the slurry displacer is configured to be engaged when the slurry pump is not engaged.

19. The polishing apparatus of claim 11, further comprising a multi-position valve for connecting an alternative solution source to the drop line, wherein the multi-position is capable of flowing the alternative solution when the slurry pump is not engaged.

20. The polishing apparatus of claim 19, further comprising an engageable slurry pump capable of pumping slurry through the drop line to a polishing machine, and wherein the multi-position valve is located closer to the polishing machine than is the slurry pump.

21. The polishing apparatus of claim 19, further comprising an engageable slurry pump capable of pumping slurry through the conduit to a polishing machine, and wherein the slurry pump is located on the drop line closer to the polishing machine than is the multi-position valve.

22. The polishing apparatus of claim 2, wherein the variable volume chamber comprises a first variable volume chamber and a second variable volume chamber, and wherein the first and second variable volume chambers impart plus-minus movement to the slurry by moving slurry between them.

23. A polishing apparatus, comprising:

a conduit capable of flowing a slurry; and means for imparting plus-minus movement to the slurry in the conduit when engaged, wherein the plus-minus movement is relative to the flow, if any, of slurry within the conduit.

24. The polishing apparatus of 23, claim wherein the means for imparting comprises a variable volume chamber, and wherein varying the volume of the variable volume chamber imparts the plus-minus movement to the slurry.

25. The polishing apparatus of claim 24, further comprising a piston capable of varying the volume in the variable volume chamber.

26. The polishing apparatus of claim 24, further comprising a flexible wall capable of varying the volume in the variable volume chamber.

27. The polishing apparatus of claim 26, further comprising an actuator arm coupled to the flexible wall.

28. The polishing apparatus of claim 26, further comprising two flexible walls capable of varying the volume of the variable volume chamber, and further comprising a sensor in communication with a space between the two flexible walls to detect flexible wall failure.

29. The polishing apparatus of claim 24, further comprising a system in communication with the variable volume chamber to vary the volume of the variable volume chamber, and wherein the system is hydraulic or pneumatic.

30. The polishing apparatus of claim 23, further comprising a controller for sensing a quantity of slurry flow in the conduit, and wherein the controller engages means for imparting in response to the quantity of slurry flow.

31. The polishing apparatus of claim 23, wherein the conduit comprises a forward line capable of supplying slurry from a slurry reservoir to a polishing machine.

32. The polishing apparatus of claim 23, wherein the conduit comprises a return line capable of supplying slurry from a polishing machine to a slurry reservoir.

33. The polishing apparatus of claim 23, wherein the conduit comprises a drop line capable of flowing a slurry to a polishing machine.

34. The polishing apparatus of claim 33, further comprising a valve for directing slurry through the drop line.

35. The polishing apparatus of claim 33, wherein the drop line has an end in communication with the polishing machine, and wherein the valve is placed closer to the polishing machine than is the means for imparting.

36. The polishing apparatus of claim 35, wherein the means for imparting is engaged when the valve is closed.

37. The polishing apparatus of claim 33, further comprising a multi-position valve for connecting an alternative solution source to the drop line, wherein the multi-position valve is capable of flowing either the alternative solution or the slurry to the polishing machine.

38. The polishing apparatus of claim 37, wherein the drop line has an end in communication with the polishing machine, and wherein the multi-position valve is placed closer to the polishing machine than is the means for imparting.

39. The polishing apparatus of claim 33, further comprising an engageable slurry pump capable of pumping slurry through the conduit.

40. The polishing apparatus of claim 39, wherein the means for imparting is configured to be engaged when the slurry pump is not engaged.

41. The polishing apparatus of claim 33, further comprising a multi-position valve for connecting an alternative solution source to the drop line, wherein the multi-position is capable of flowing the alternative solution when the slurry pump is not engaged.

42. The polishing apparatus of claim 41, further comprising an engageable slurry pump capable of pumping slurry through the drop line to a polishing machine, and wherein the multi-position valve is located closer to the polishing machine than is the slurry pump.

43. The polishing apparatus of claim 41, further comprising an engageable slurry pump capable of pumping slurry through the conduit to a polishing machine, and wherein the slurry pump is located on the drop line closer to the polishing machine than is the multi-position valve.

44. The polishing apparatus of claim 24, wherein the variable volume chamber comprises a first variable volume chamber and a second variable volume chamber, and wherein the first and second variable volume chambers impart plus-minus movement to the slurry by moving slurry between them.

45. A polishing system, comprising:

a slurry reservoir;

a slurry loop in communication with the slurry reservoir for circulating slurry to a polishing machine;

at least one polishing machine which receives slurry from the slurry loop; and a slurry displacer in communication with the slurry loop capable of imparting plus-minus movement to the slurry when engaged, wherein the plus-minus movement is relative to the flow, if any, of slurry within the slurry loop.

46. The polishing system of claim 45, wherein the slurry displacer comprises a variable volume chamber, and wherein varying the volume of the variable volume chamber imparts the plus-minus movement to the slurry.

47. The polishing system of claim 46, further comprising a piston capable of varying the volume in the variable volume chamber.

48. The polishing system of claim 46, further comprising a flexible wall capable of varying the volume in the variable volume chamber.

49. The polishing system of claim 48, further comprising an actuator arm coupled to the flexible wall.

50. The polishing system of claim 46, further comprising two flexible walls capable of varying the volume of the variable volume chamber, and further comprising a sensor in communication with a space between the two flexible walls to detect flexible wall failure.

51. The polishing system of claim 46, further comprising a system in communication with the variable volume chamber to vary the volume of the variable volume chamber, and wherein the system is hydraulic or pneumatic.

52. The polishing system of claim 45, further comprising a controller for sensing a quantity of slurry flow in the slurry loop, and wherein the controller engages the slurry displacer in response to the quantity of slurry flow.

53. The polishing system of claim 45, wherein the slurry displacer is located on a forward line of the slurry loop for supplying slurry from a slurry reservoir to a polishing machine.

54. The polishing system of claim 45, wherein the slurry displacer is located on a return line of the slurry loop for supplying slurry from a polishing machine to a slurry reservoir.

55. The polishing system of claim 45, further comprising an engageable slurry pump capable of pumping slurry through the slurry loop.

56. The polishing system of claim 55, wherein the slurry displacer is configured to be engaged when the slurry pump is not engaged.

57. The polishing system of claim 46, wherein the variable volume chamber comprises a first variable volume chamber and a second variable volume chamber, and wherein the first and second variable volume chambers impart plus-minus movement to the slurry by moving slurry between them.

58. A polishing system, comprising:

a slurry reservoir;

a drop line in communication with the slurry reservoir to supply slurry to least one polishing machine; and a slurry displacer in communication with the drop line capable of imparting plus-minus movement to the slurry when engaged, wherein the plus-minus movement is relative to the flow, if any, of slurry within the conduit.

59. The polishing system of claim 58, wherein the slurry displacer comprises a variable volume chamber, and wherein varying the volume of the variable volume chamber imparts the plus-minus movement to the slurry.

60. The polishing system of claim 59, further comprising a piston capable of varying the volume in the variable volume chamber.

61. The polishing system of claim 59, further comprising a flexible wall capable of varying the volume in the variable volume chamber.

62. The polishing system of claim 61, further comprising an actuator arm coupled to the flexible wall.

63. The polishing system of claim 59, further comprising two flexible walls capable of varying the volume of the variable volume chamber, and further comprising a sensor in communication with a space between the two flexible walls to detect flexible wall failure.

64. The polishing system of claim 59, further comprising a system in communication with the variable volume chamber to vary the volume of the variable volume chamber, and wherein the system is hydraulic or pneumatic.

65. The polishing system of claim 58, further comprising a controller for sensing a quantity of slurry supplied by the slurry reservoir, and wherein the controller engages the slurry displacer in response to the quantity of slurry flow.

66. The polishing system of claim 58, further comprising a valve for directing slurry through the drop line.

67. The polishing system of claim 66, wherein the drop line has an end in communication with the polishing machine, and wherein the valve is placed closer to the polishing machine than is the slurry displacer.

68. The polishing system of claim 67, wherein the slurry displacer is engaged when the valve is closed.

69. The polishing system of claim 58, further comprising a multi-position valve for connecting an alternative solution source to the drop line, wherein the multi-position valve is capable of flowing either the alternative solution or the slurry to the polishing machine.

70. The polishing system of claim 69, wherein the drop line has an end in communication with the polishing machine, and wherein the multi-position valve is placed closer to the polishing machine than is the slurry displacer.

71. The polishing system of claim 58, further comprising an engageable slurry pump capable of pumping slurry through the drop line.

72. The polishing system of claim 71, wherein the slurry displacer is configured to be engaged when the slurry pump is not engaged.

73. The polishing system of claim 58, further comprising a multi-position valve for connecting an alternative solution source to the drop line, wherein the multi-position valve is capable of flowing the alternative solution source when the slurry pump is not engaged.

74. The polishing system of claim 73, further comprising an engageable slurry pump capable of pumping slurry through the conduit to a polishing machine, and wherein the multiposition valve is located closer to the polishing machine than is the slurry pump.

75. The polishing system of claim 73, further comprising an engageable slurry pump capable of pumping slurry through the conduit to a polishing machine, and wherein the slurry pump is located on the drop line closer to the polishing machine than is the multi-position valve.

76. A method of preserving a slurry suspension in a conduit in a polishing apparatus, comprising displacing slurry through the conduit by importing plus-minus movement to the slurry, wherein the plus-minus movement is relative to the flow, if any, of slurry within the conduit.

77. The method of claim 76, wherein displacing the slurry comprises varying the volume of a variable volume chamber in communication with the conduit to impart the plus-minus movement to the slurry.

78. The method of claim 77, wherein varying the volume in the variable volume chamber comprises the use of a piston in communication with the variable volume chamber.

79. The method of claim 77, wherein varying the volume in the variable volume chamber comprises pulling and pushing a flexible wall in communication with the variable volume chamber.

80. The method of claim 79, wherein pushing and pulling the flexible wall comprises the use of an actuator arm coupled to the flexible wall.

81. The method of claim 77, wherein varying the volume in the variable volume chamber comprises pulling and pushing two flexible walls in communication with the variable volume chamber, and further comprising sensing the conditions in a space between the two flexible walls to detect flexible wall failure.

82. The method of claim 77, wherein varying the volume in the variable volume chamber comprises the use of a system, and wherein the system is hydraulic or pneumatic.

83. The method of claim 77, wherein the conduit comprises a forward line for supplying slurry from a slurry reservoir to a polishing machine.

84. The method of claim 76, wherein the conduit comprises a return line for supplying slurry from a polishing machine to a slurry reservoir.

85. The method of claim 76, wherein the conduit comprises a drop line for flowing the slurry to a polishing machine.

86. A method of operating a polishing system, the system comprising a slurry reservoir and a slurry loop in communication with the slurry reservoir for circulating slurry to a polishing machine, the method comprising:

detecting a quantity of slurry flow in the slurry loop; and displacing slurry in at least a portion of the slurry loop by importing plus-minus movement to the slurry in the slurry loop in response the detected quantity of slurry flow, wherein the plus-minus movement is relative to the flow, if any, of slurry within the slurry loop.

87. The method of claim 86, wherein displacing the slurry comprises varying the volume of a variable volume chamber in communication with the slurry loop to impart the plus-minus movement to the slurry.

88. The method of claim 87, wherein varying the volume in the variable volume chamber comprises the use of a piston in communication with the variable volume chamber.

89. The method of claim 87, wherein varying the volume in the variable volume chamber comprises pulling and pushing a flexible wall in communication with the variable volume chamber.

90. The method of claim 89, wherein pushing and pulling the flexible wall comprises the use of an actuator arm coupled to the flexible wall.

91. The method of claim 87, wherein varying the volume in the variable volume chamber comprises pulling and pushing two flexible walls in communication with the variable volume chamber, and further comprising sensing the conditions in a space between the two flexible walls to detect flexible wall failure.

92. The method of claim 87, wherein varying the volume in the variable volume chamber comprises the use of a system, and wherein the system is hydraulic or pneumatic.

93. The method of claim 86, wherein displacing the slurry occurs only in a forward line of the slurry loop.

94. The method of claim 86, wherein displacing the slurry occurs only in a return line of the slurry loop.

95. The method of claim 86, wherein slurry is circulated though the slurry loop by the use of a pump.

96. The method of claim 86, further comprising sensing a quantity of slurry flow through the loop, and wherein slurry displacement occurs only when sensed quantity of slurry flow reaches a certain quantity.

97. A method of operating a polishing system, the system comprising a drop line for supplying slurry to least one polishing machine, a pump for supply slurry through the drop line, and a valve coupled to the drop line, the method comprising:

engaging the valve to stop the flow of slurry to the polishing machine; and displacing slurry in a first portion of the drop line by importing plus-minus movement to the slurry in the drop line.

98. The method of claim 97, wherein displacing the slurry comprises varying the volume of a variable volume chamber in communication with the slurry loop to impart the plus-minus movement to the slurry.

99. The method of claim 98, wherein varying the volume in the variable volume chamber comprises the use of a piston in communication with the variable volume chamber.

100. The method of claim 98, wherein varying the volume in the variable volume chamber comprises pulling and pushing a flexible wall in communication with the variable volume chamber.

101. The method of claim 100, wherein pushing and pulling the flexible wall comprises the use of an actuator arm coupled to the flexible wall.

102. The method of claim 98, wherein varying the volume in the variable volume chamber comprises pulling and pushing two flexible walls in communication with the variable volume chamber, and further comprising sensing the conditions in a space between the two flexible walls to detect flexible wall failure.

103. The method of claim 98, wherein varying the volume in the variable volume chamber comprises the use of a system, and wherein the system is hydraulic or pneumatic.

104. The method of claim 97, wherein the pump is coupled to the first portion of the drop line.

105. The method of claim 97, further comprising as the first step in the method disengaging the pump.

106. The method of claim 97, wherein the valve comprises a multi-position valve coupled to an alternative solution source.

107. The method of claim 106, further comprising supplying the alternative solution to the polishing machine through a second portion of the drop line between the multi-position valve and the polishing machine.

108. The method of claim 97, wherein the pump is coupled to the second portion of the drop line.

109. A method of operating a slurry delivery system in a polishing apparatus, comprising:

supplying a continuous flow of slurry through a conduit; and displacing the continuously flowing slurry by imparting plus-minus movement to the slurry relative to the continuous flow.

110. The method of claim 109, wherein displacing the slurry comprises varying the volume of a variable volume chamber in communication with the conduit to impart the plus-minus movement to the slurry.

111. The method of claim 110, wherein varying the volume in the variable volume chamber comprises the use of a piston in communication with the variable volume chamber.

112. The method of claim 110, wherein varying the volume in the variable volume chamber comprises pulling and pushing a flexible wall in communication with the variable volume chamber.

113. The method of claim 112, wherein pushing and pulling the flexible wall comprises the use of an actuator arm coupled to the flexible wall.

114. The method of claim 110, wherein varying the volume in the variable volume chamber comprises pulling and pushing two flexible walls in communication with the variable volume chamber, and further comprising sensing the conditions in a space between the two flexible walls to detect flexible wall failure.

115. The method of claim 110, wherein varying the volume in the variable volume chamber comprises the use of a system, and wherein the system is hydraulic or pneumatic.

116. The method of claim 109, wherein the conduit comprises a forward line for supplying slurry from a slurry reservoir to a polishing machine.

117. The method of claim 109, wherein the conduit comprises a return line for supplying slurry from a polishing machine to a slurry reservoir.

118. The method of claim 109, wherein the conduit comprises a drop line for flowing the slurry to a polishing machine.

* * * * *